US006401962B1

(12) United States Patent
Littlejohn et al.

(10) Patent No.: US 6,401,962 B1
(45) Date of Patent: Jun. 11, 2002

(54) DISPOSABLE FOOD SERVING BOWL

(75) Inventors: Mark B. Littlejohn, Appleton; Cristian M. Neculescu, Neenah; Margaret P. Neer, Neenah; Greg A. Wendt, Neenah, all of WI (US)

(73) Assignee: Fort James Corporation, Deerfield, IL (US)

( * ) Notice: Subject to any disclaimer, the term of this patent is extended or adjusted under 35 U.S.C. 154(b) by 0 days.

(21) Appl. No.: 09/603,578

(22) Filed: Jun. 26, 2000

Related U.S. Application Data

(60) Provisional application No. 60/142,133, filed on Jul. 2, 1999.

(51) Int. Cl.[7] ..... A47G 19/02

(52) U.S. Cl. ..... 220/574; 229/406

(58) Field of Search ..... 220/574, 657, 220/659; 229/406, 407

(56) References Cited

U.S. PATENT DOCUMENTS

| | | | | |
|---|---|---|---|---|
| D41,986 | S | 12/1911 | Smith | |
| D51,874 | S | 3/1918 | Beyrand | |
| D61,248 | S | 7/1922 | Reizenstein | |
| 1,440,070 | A | 12/1922 | Fry | |
| D66,556 | S | 2/1925 | Cunningham | |
| D76,433 | S | 9/1928 | Tams | |
| D86,627 | S | 3/1932 | Newton | |
| 1,848,066 | A | 3/1932 | Shephard et al. | |
| D88,688 | S | 12/1932 | Thompson | |
| D103,599 | S | 3/1937 | Ruck | |
| D106,554 | S | 10/1937 | Wilson | |
| D109,494 | S | 5/1938 | Leigh | |
| D116,789 | S | 9/1939 | Barbiers | |
| D116,790 | S | 9/1939 | Barbiers | |
| D135,030 | S | 2/1943 | Harshman | |
| D140,345 | S | 2/1945 | Fordyce | |
| D164,669 | S | 10/1951 | Chaplin | D44/15 |
| D169,133 | S | 3/1953 | Foster | D44/10 |
| D179,011 | S | 10/1956 | Kimble | D36/2 |
| 2,928,567 | A | 3/1960 | Davis | 220/13 |
| D188,502 | S | 8/1960 | Metzler et al. | D44/15 |
| D190,336 | S | 5/1961 | Denni et al. | D44/15 |
| 3,001,665 | A | 9/1961 | Tomarin | 220/4 |
| 3,067,922 | A | * 12/1962 | Hill | 229/406 |
| D221,290 | S | 7/1971 | Wiedemann | D7/1 |
| 3,672,538 | A | 6/1972 | Wiedemann et al. | 220/97 C |
| 3,675,811 | A | 7/1972 | Artz | 220/20 |
| D232,613 | S | 9/1974 | Cheladze | D7/1 |
| 3,931,890 | A | 1/1976 | Davis | 206/508 |
| D250,928 | S | 1/1979 | Franklin | D7/1 |
| D251,713 | S | 5/1979 | Brody | D7/28 |
| D275,255 | S | 8/1984 | Durand | D7/28 |
| D276,117 | S | 10/1984 | Solt | D7/36 |
| D279,345 | S | 6/1985 | Durand | D7/28 |
| 4,578,296 | A | 3/1986 | Miyazaki et al. | 428/35 |
| 4,609,140 | A | * 9/1986 | Van Handel et al. | 229/406 |
| 4,734,450 | A | 3/1988 | Kawai et al. | 524/413 |
| 4,809,876 | A | 3/1989 | Tomaswick et al. | 220/458 |
| 4,933,526 | A | 6/1990 | Fisher et al. | 219/10.55 M |
| 4,981,631 | A | 1/1991 | Cheung et al. | 264/50 |

(List continued on next page.)

FOREIGN PATENT DOCUMENTS

| | | | |
|---|---|---|---|
| EP | 0 407 198 A1 | 1/1991 | B65D/85/00 |
| EP | 0 841 150 A2 | 5/1998 | B29D/7/01 |

*Primary Examiner*—M. D. Patterson
*Assistant Examiner*—Troy Arnold
(74) *Attorney, Agent, or Firm*—Michael W. Ferrell

(57) ABSTRACT

A disposable food serving bowl formed of a mineral-filled polyolefin sheet has a substantially planar central portion, a sidewall portion and a characteristic volume V. The bowl is further characterized by way of a flange projecting outwardly from the sidewall which defines an outer arcuate rim portion with a radius of curvature subtending an outermost arc. The radius of curvature of the outermost arc is from about $(V/20)^{1/3}\times0.15$ to about $(V/20)^{1/3}\times0.35$.

41 Claims, 3 Drawing Sheets

U.S. PATENT DOCUMENTS

| | | | | | |
|---|---|---|---|---|---|
| D316,800 | S | | 5/1991 | Wertheim | D7/548 |
| 5,023,286 | A | | 6/1991 | Abe et al. | 524/128 |
| 5,045,369 | A | | 9/1991 | Kobayashi et al. | 428/36.7 |
| 5,088,640 | A | * | 2/1992 | Littlejohn | 229/406 |
| 5,165,978 | A | | 11/1992 | Lecinski | 428/66 |
| 5,184,995 | A | | 2/1993 | Kuchenbecker | 493/79 |
| 5,230,939 | A | * | 7/1993 | Baum | 428/84 |
| D342,186 | S | | 12/1993 | Frere | D7/396.1 |
| 5,300,747 | A | | 4/1994 | Simon | 219/729 |
| D348,804 | S | | 7/1994 | Feer | D7/560 |
| 5,326,020 | A | * | 7/1994 | Cheshire et al. | 229/407 |
| D351,316 | S | | 10/1994 | Mann | D7/556 |
| D351,968 | S | | 11/1994 | Zivin | D7/564 |
| D354,884 | S | | 1/1995 | Carranza | D7/564 |
| 5,377,860 | A | | 1/1995 | Littlejohn et al. | 220/306 |
| 5,439,628 | A | | 8/1995 | Huang | 264/175 |
| D364,537 | S | | 11/1995 | Anderson | D7/553 |
| 5,622,780 | A | | 4/1997 | Paleari | 428/328 |
| 5,665,442 | A | | 9/1997 | Andersen et al. | 428/36.4 |
| D386,048 | S | | 11/1997 | Bebaway | D7/549 |
| 5,758,773 | A | | 6/1998 | Clements | 206/519 |

* cited by examiner

DISPOSABLE FOOD SERVING BOWL

This application claims the benefit of U.S. Provisional Application No. 60/142,133, filed Jul. 2, 1999.

TECHNICAL FIELD

The present invention relates generally to disposable food contact articles and more specifically to a disposable food serving bowl formed of a high modulus, mineral-filled polyolefin sheet and more preferably mineral-filled sheet.

BACKGROUND

Disposable articles are commonly formed with a curled lip to impart strength to a cup, canister, or carton for example, as is seen in U.S. Pat. No. 5,184,995 to Kuchenbecker. The curl tends to give the article a utilitarian look and feel, not necessarily optimally aesthetically pleasing; especially for disposable articles which can be re-used on multiple occasions such as plastic articles.

There is shown in the U.S. Pat. No. 4,578,296 of Miyazaki et al. a thermoformed article manufactured from filled polyolefin sheet. The polyolefin resin composition includes from 30 to 80 percent of resin, from 19 to 69 percent by weight talc and from 1 to 10 percent by weight titanium dioxide. An article formed from the sheet typically includes a curled lip or a severely downwardly projecting outer lip. Note column 9, line 49 through column 10, line 38.

In accordance with the present invention, there are provided disposable serving bowls without a curled or severely downturned flange, which features are undesirable in terms of aesthetic qualities and brittleness.

SUMMARY OF THE INVENTION

The invention is described below with reference to the attached figures which show preferred shapes and relative dimensions.

The bowls of the present invention include in a preferred embodiment a plastic bowl with a four-radius profile which balances the need for increased rigidity (strength) and rim stiffness (sturdiness) per given material weight/cost. The ergonomic rim profile provides for ease of holding and carrying, consumer friendly shape denoting Permanentware qualities, without the negative side effect of brittleness encountered when using high modulus/stiffness construction materials. The four-radius disposable plastic bowl design has a curvilinear rim surface onto which patterning can be applied for visual, tactile and strength purposes. The bowls were rigid and strong, not brittle, during use even with the high modulus/stiffness mica-filled polypropylene (PP) plastic material.

Bowls produced with other shapes were rigid but often failed by brittle cracking in the flange and downturn areas. The stresses generated in the flange and downturn areas by deflection of the product during use apparently exceeded the highly filled material strength resulting in failure. It is possible that imperfections on the product's trimmed edge may contribute to brittle cracking by providing failure initiation points for the notch sensitive, highly filled materials preferably used in accordance with the invention.

It was discovered that plastic bowls described in this invention disclosure still had exceptional strength per material weight, but also significantly reduced brittle cracking with the highly filled nonhomogeneous materials. The four-radius design, for example, would not build up the high stress levels during deflection even with trimmed edge imperfections and was less prone to brittle cracking.

Bowls having a circular configuration as illustrated employ the four-radius plastic bowl design. The plastic bowls may also be square or rectangular in shape having angular comers. Further, additional plastic shapes such as triangular, multi-sided, polyhexal, etc. are contemplated.

It will be appreciated that a salient feature of the inventive bowls is the smooth profile as described herein. In general, the transitions between the center, sidewall and flange of the bowl are kept free of bends or curves so that mechanical stresses are not concentrated beyond the ability of the material to withstand them. In addition to being operative to avoid undesirable stress regions, the profile is flowing in appearance and provides a pleasing, ergonomic hand feel.

In general, the invention is directed to disposable food serving bowls formed of a polyolefin, mineral-filled sheet and having a characteristic diameter as well as a substantially planar central portion, a sidewall portion and a flange portion. For a circular article such as a circular bowl, the characteristic diameter is simply the diameter of the bowl as the term is ordinarily employed, i.e., the distance through the center between opposing outer edges of the flange. For non-circular articles, the characteristic diameter is the average distance through the center between opposing outer edges of the flange. Thus, for a rectangular article the characteristic diameter is the average of the shorter side and the longer side, for an oval article the characteristic diameter is the average of the minor axis length and the major axis length of the oval and so forth.

There is provided in a first aspect of the present invention a disposable food serving bowl formed of a mineral-filled polyolefin sheet including a substantially planar central portion, a sidewall portion and a flange portion having a characteristic diameter, D, measured in inches, as well as a characteristic volume, V, measured in U.S. fluid ounces. As used herein, the term "fluid ounces" refers to U.S. fluid ounces or 1.805 cubic inches. It will be appreciated that while a nominal 20 fluid ounce bowl is specifically exemplified, such a bowl may have a slightly greater "full to the brim" capacity" of 23 fluid ounces or more to allow for slight changes in orientation during movement or use. Likewise, a nominal 20 ounce bowl could contain less than 20 fluid ounces (say 19 ounces or so) if filled to a level at the start of the flange region.

The sidewall portion extends outwardly and upwardly from said central planar portion; while the flange portion extends outwardly from the sidewall portion and is characterized by an outer arcuate rim portion with a radius of curvature subtending an outermost arc. The outermost rim portion also defines the outer edge of the bowl and has a downwardly projection terminus. The radius of curvature of said outermost arc in inches is from about $(V/20)^{1/3}\times0.15$ to about $(V/20)^{1/3}\times0.35$. Preferably, the radius of curvature of the outermost arc is from about $(V/20)^{1/3}\times0.2$ to about $(V/20)^{1/3}\times0.3$. The outermost arc typically extends over a total angle of from about 60 to about 85 degrees, and most preferably over an angle from about 70 to about 75 degrees. The outermost arc typically also extends from a vertical line at its apex or peak downwardly through an angle of from about 35 to about 55 degrees. More preferably, the outermost arc extends from a vertical line at its apex or peak downwardly through an angle of from about 40 to about 50 degrees.

The bowls typically have a wall thickness of from about 10 to about 80 thousandths of an inch (mils) and preferably from about 15 to about 25 mils. The most preferred materials are crack resistant, filled polypropylenes consisting essentially of from about 40 to about 90 percent by weight of a polypropylene polymer, from about 10 to about 60 percent by weight of a mineral filler, from about 1 to about 15 percent by weight polyethylene, from about 0.1 to about 5 weight percent titanium dioxide and optionally including a basic organic or inorganic compound comprising the reaction product of an alkali metal or alkaline earth element with carbonates, phosphates, carboxylic acids as well as alkali metal and alkaline earth element oxides, hydroxides, or silicates and basic metal oxides, including mixtures of silicon dioxide with one or more of the following oxides: magnesium oxide, calcium oxide, barium oxide, and mixtures thereof.

Preferably, the basic organic or inorganic compound comprises calcium carbonate and the calcium carbonate is present in an amount of from about 5 to about 20 weight percent. Polyethylene is usually present from about 2.5 to about 15 percent by weight; however, typically from about 4 to about 5 weight percent is more preferred.

Titanium dioxide is generally present from about 0.1 to about 3 weight percent; more typically, titanium dioxide is present from about 0.25 to about 2 percent by weight. Most preferably, titanium dioxide is present in an amount of at least about 0.5 percent by weight.

Generally, the bowls have a wall caliper of from about 10 to anywhere from about 50 to about 80 mils; while a wall caliper of from about 15 to about 25 mils is more typical. A preferred mineral filler is mica and a preferred polypropylene polymer is isotactic polypropylene which has a melt index of from about 0.3 to about 4. Most preferably, the isotactic polypropylene has a melt flow index of about 1.5.

Particularly preferred polyethylenes include HDPE and LLDPE.

In another aspect of the invention there is provided a disposable food serving bowl formed of a mineral-filled polyolefin sheet comprising a planar central portion, a sidewall portion and a flange portion, the sidewall portion extending outwardly and upwardly from the central planar portion; and the flange portion extending outwardly from said sidewall portion and being characterized by an outer arcuate rim portion with a radius of curvature subtending an outermost arc. The outermost rim portion defines the outer edge of said bowl which has a downwardly projecting terminus. The radius of curvature of said outermost arc is from about 0.15 inches to about 0.35 inches. The radius of curvature of the outermost arc is typically from about 0.2 to about 0.3 inches, while the polyolefin is typically polyethylene, polypropylene or mixtures thereof.

In still yet another aspect of the present invention there is provided a disposable food serving bowl formed from a mineral-filled polyolefin sheet with a characteristic volume, V, in (U.S.) fluid ounces, having a substantially planar center portion; a first sidewall portion extending outwardly from said center planar portion, said first sidewall portion being upwardly convex and subtending a first arc with a first radius of curvature; a second sidewall portion joined to said first sidewall portion, and extending outwardly therefrom, said second sidewall portion being downwardly convex, subtending a second arc with a second radius of curvature; a third sidewall portion joined to said second sidewall portion and extending outwardly therefrom, said third sidewall portion being downwardly convex, subtending a third arc with a third radius of curvature; and, a fourth rim portion joined to said third sidewall portion and extending outwardly therefrom, said fourth rim portion being downwardly convex subtending a fourth arc having a fourth radius of curvature; wherein said fourth radius of curvature, in inches, is from about $(V/20)^{1/3}\times0.15$ to about $(V/20)^{1/3}\times0.35$. As noted above, the fourth arc passes through a vertical maximum and continues downwardly through an angle of from about 35 to about 55 degrees in a downwardly convex manner.

Typically, the second radius of curvature is greater than the third radius of curvature and the third radius of curvature is greater than the first radius of curvature which, in turn, is greater than the fourth radius of curvature.

The first arc and the second arc are similar or equivalent in length and both of which are greater in length than the third arc. The third arc is typically greater in length than the fourth arc.

As will be seen from the following description, the first arc extends over an angle of from about 50 to about 85 degrees, the second arc extends over an angle of from about 5 to about 9 degrees, the third arc extends over an angle of from about 25 to about 40 degrees, while the fourth arc extends over an angle of from about 60 to about 85 degrees; and from about 35 to about 55 degrees from its vertical maximum or apex.

Various details will become more understood by reference to the attached Appendix, drawings and detailed description which follows.

BRIEF DESCRIPTION OF DRAWINGS

The invention is described in detail below with reference to the various, drawings. In the drawings.

DETAILED DESCRIPTION

Figure 1A:
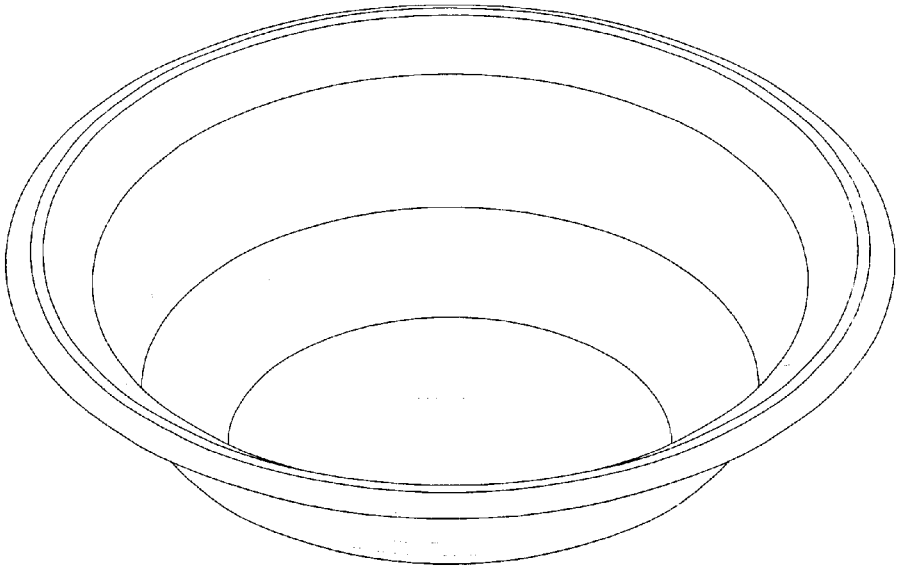
FIGS. 1A and B are drawings of a bowl of this invention.

The invention is described in detail below with reference to the figures. Such description is for purposes of illustration only and is not limitative of the invention in any way. Preferred materials are plastics or filled plastics. Typically, in filled plastics the primary mineral filler is mica, talc, kaolin, bentonite, wollastonite, milled glass fiber, glass beads (solid or hollow), silica, or silicon carbide whiskers or mixtures thereof. We have discovered that when polypropylene is melt-compounded with acidic-type minerals the resulting mixture has a higher odor index (offensive odors) that would disqualify them from use in food service products.

Acidic type fillers such as mica; natural clay minerals such as kaolinite, bentonite, attapulgite, montmorillonite, clarite, or fuller's earth; and silica are particularly detrimental in generating odor compounds when processed under high shear and high temperature conditions experienced during twin screw compounding. We have found that changing the compounding process and adding a basic or other odor supressing compound or component to the primary acidic filler allows the production of low odor index compounds. The reason for this effect is unknown since the fundamental cause of the degradation in polypropylene may be due, in part, to catalysis effects caused by impurities in the mineral as well as its acidic or basic nature. In this regard, the addition of $CaCO_3$ to talc is beneficial whereas, it may be unnecessary when wollastonite is used as the primary filler.

The preferred primary fillers are mica, talc, kaolin, bentonite, milled glass fibers, and wollastonite or mixtures thereof. Of these, milled glass fibers and wollastonite are basic in nature and may not necessarily require the addition of a secondary basic component. An odor suppressing compound is also preferably included. As noted above, suitable mineral fillers include mica, talc, kaolin, bentonite, wollastonite, milled glass fiber, glass beads (hollow or solid), silica whiskers, silicon carbide whiskers and mixtures thereof as well as the mineral fillers recited herein, whereas the basic organic or inorganic compound is generally the reaction product of an alkali metal or alkaline earth element with carbonates, phosphates, carboxylic acids as well as alkali metal and alkaline earth element oxides, hydroxides, or silicates and basic metal oxides including mixtures of silicon dioxide with one or more of the following oxides: magnesium oxide, calcium oxide, barium oxide, and mixtures of the foregoing. More specifically, the basic organic or inorganic compound may be selected from the group consisting of: calcium carbonate, sodium carbonate, potassium carbonate, barium carbonate, aluminum oxide, sodium silicate, sodium borosilicate, magnesium oxide, strontium oxide, barium oxide, zeolites, sodium citrate, potassium citrate, calcium stearate, potassium stearate, sodium phosphate, potassium phosphate, magnesium phosphate, mixtures of silicon dioxide with one or more of the following oxides: magnesium oxide, calcium oxide, barium oxide, and mixtures of one or more of the above. Furthermore, hydroxides of the metals and alkaline earth elements recited above may be utilized.

Where a basic inorganic odor suppressing compound is chosen, generally such compound is selected from the group consisting of calcium carbonate, sodium carbonate, potassium carbonate, barium carbonate, aluminum oxide, sodium silicate, sodium borosilicate, magnesium oxide, strontium oxide, barium oxide, zeolites, sodium phosphate, potassium phosphate, magnesium phosphate, mixtures of silicon dioxide with one or more of the following oxides: magnesium oxide, calcium oxide, barium oxide, and mixtures of one or more of the basic inorganic compounds set forth above. The amount of a basic inorganic compound is generally from about 2 to 20 weight percent, but is usually from about 5 to about 15 weight percent of the article. Most preferably the basic inorganic compound selected is calcium carbonate; typically present from about 5 to about 20 weight percent.

Where an organic compound is chosen, it is typically selected from the group consisting of sodium stearate, calcium stearate, potassium stearate, sodium citrate, potassium citrate, and mixtures of these where the amount of such compound is from about 0.5 to about 2.5 weight percent of the article. Typically, microwaveable articles produced in accordance with the present invention exhibit an odor index of less than about 0.75; preferably less than about 0.6; with a practical lower limit being 0.1 or so.

As shown below in connection with microwaveability testing, and summarized in Table 20, competing commercial polystyrene type plates cannot withstand the high temperatures generated in the microwave oven during food contact and either significantly warp or deform when the aforementioned food products were heated on them. Under the usual microwaving conditions with high grease content foods, the prior art plates tend to deform and flow to the point where parts of the plate become adhered to the inside of the microwave oven. For disposable plates and containers, having suitable food contact olfactory properties, appearance and feel are important attributes. Another significant property of the containers and plates of this invention is their cut resistance. These rigid articles of manufacture are of sufficient toughness to be resistant to cutting by serrated polystyrene flatware. In normal usage they are also resistant to cutting by regular metal flatware.

Whereas any microwaveable article may be produced in accordance with the invention, most typically the article is a bowl or a plate suitable for serving food at a meal. Preferred articles are thermoformed and include a micronodular food contact surface. Micronodular food contact surfaces are produced by thermoforming a sheet into the article which has been extruded optionally with at least one matte roll and by vacuum thermoforming the sheet by applying vacuum opposite to the surface where the micronodular surface is desired. Most typically the micronodular surface will have a surface gloss of less than about 35 at 75° as measured by TAPPI method T-480-OM 92. Articles also will typically have a Parker Roughness Value of at least about 12 microns.

While any suitable polypropylene polymer may be used, the polypropylene polymers are preferably selected from the group consisting of isotactic polypropylene, and copolymers of propylene and ethylene wherein the ethylene moiety is less than about 10% of the units making up the polymer, and mixtures thereof. Generally, such polymers have a melt flow index from about 0.3 to about 4, but most preferably the polymer is isotactic polypropylene with a melt-flow index of about 1.5. In particularly preferred embodiments, the melt-compounded composition from which the resultant extruded sheet is formed into articles further includes a polyethylene component and titanium dioxide. The polyethylene component may be any suitable polyethylene such as HDPE, LDPE, MDPE, LLDPE or mixtures thereof.

The various polyethylene polymers referred to herein are described at length in the *Encyclopedia of Polymer Science & Engineering* (2d Ed.), Vol. 6; pp: 383–522, Wiley 1986; the disclosure of which is incorporated herein by reference. HDPE refers to high density polyethylene which is substantially linear and has a density of generally greater that 0.94 up to about 0.97 g/cc. LDPE refers to low density polyethylene which is characterized by relatively long chain branching and a density of about 0.912 to about 0.925 g/cc. LLDPE or linear low density polyethylene is characterized by short chain branching and a density of from about 0.92 to about 0.94 g/cc. Finally, intermediate density polyethylene (MDPE) is characterized by relatively low branching and a density of from about 0.925 to about 0.94 g/cc. Unless otherwise indicated these terms have the above meaning throughout the description which follows.

The microwaveable articles according to the invention typically exhibit melting points from about 250 to about 330° F. and include mica or other primary fillers in amounts from about 20 to about 35 weight percent. Most preferably mica is present at about 30 weight percent, and calcium carbonate is present from about 8 to about 12 weight percent.

It has been found that C8 and C9 organic ketones correlate well with or are associated with undesirable odors in polypropylene/mica compositions. Accordingly, it is preferred that articles in accordance with the invention are substantially free from volatile C8 and C9 organic ketones. In order to avoid undesirable odors, articles in accordance with the invention are preferably prepared from a melt-compounded polyolefin mica composition which is prepared at a process melt temperature of less than about 425° F.; with below about 400° F. being even more preferred. Optionally, the melt processed polyolefin/mineral composition is melt-compounded in a nitrogen atmosphere.

In another aspect of the invention, there is provided a thermoformed, mineral-filled polypropylene food contact article formed from a melt-compounded composition comprising from about 40 to about 90 percent by weight of a polypropylene polymer, from about 10 to about 50 percent by weight of a primary mineral filler and an effective odor-reducing amount of a basic organic or inorganic compound operative to impart an odor index of less than about 0.75 to said melt-compounded composition.

Preferably the inventive articles are prepared from a melt-compounded polyolefin/mica composition prepared by way of a low temperature compounding process.

A preferred low temperature compounding process used for producing mineral-filled polypropylene melt-compounded compositions with an odor index of less than about 0.75 including a basic odor suppressing agent in accordance with the invention with from about 40 to about 90 percent by weight of a polypropylene polymer includes the sequential steps of: (a) preheating a polypropylene polymer while maintaining the polymer below a maximum temperature of about 370° F. and preferably below 350° F. and more preferably below a maximum of about 260° F.; but suitably above about 240° F.; followed by; (b) admixing mineral filler to said preheated polymer in an amount from about 10 to about 50 percent weight based on the combined weight of the resin and primary filler and maintaining the mixture below about 425° F.; followed by, (c) extruding the mixture. Polymer may be melted exclusively through the application of shear, or the shear may be supplemented through heating by infrared radiation or ordinary heating coils or performed externally to the mixing chamber. Preferably, the basic odor suppressing agent is added simultaneously with the mineral filler. It is desirable to keep the duration of the step of admixing mineral filler and a basic odor suppressant agent to the mixture relatively short so as not to generate compounds which cause odor and to preserve the particle size and aspect ratio of the mineral filler. Accordingly, the step of admixing the mineral filler should be no more than about five minutes with the duration of the admixing step of less than about three minutes being even more preferred. Any suitable means may be used to carry out the sequential process in accordance with the invention, however, the process is normally carried out in a batch mode in a mixing chamber provided with a pair of rotating rotors in an apparatus referred to in the industry as a Banbury type mixer. One may choose to use a twin screw extruder or a Buss kneader to practice the inventive process if so desired, provided that appropriate elements are used to minimize shear heating.

Thermoforming is typically conducted at a sheet temperature of from about 260° to about 310° F., and more preferably at a temperature of from about 280° to about 300° F.

There is provided in a still further aspect of the invention a crack-resistant, thermoformed food contact article having a wall thickness ranging from about 10 to about 80 mils consisting essentially of from about 40 to about 90 weight percent of a polypropylene polymer, from about 10 to about 50 percent by weight of a mineral filler, from about 1 to about 15 percent by weight polyethylene, from about 0.1 to about 5 weight percent titanium dioxide and optionally including a basic organic or inorganic compound. The basic compound is, generally speaking, the reaction product of an alkali metal or alkaline earth element with carbonates, phosphates, carboxylic acids as well as alkali metal and alkaline earth element oxides, hydroxides, or silicates and basic metal oxides, including mixtures of silicon dioxide with one or more of the following oxides: magnesium oxide, calcium oxide, barium oxide, and mixtures thereof. A particularly preferred article is where the basic organic or inorganic compound is calcium carbonate which is present in an amount of from about 5 to about 20 weight percent.

Polyethylene is more typically present from about 2.5 to about 15 weight percent, preferably from about 4 to about 5 weight percent of the crack resistant article. Titanium dioxide is included in various amounts, from about 0.1 to about 3 percent by weight being typical; from about 0.25 to 2 percent titanium dioxide may be included. Preferably, titanium dioxide is included in at least 0.5 percent by weight.

The caliper, or wall thickness, of the articles is usually from about 0.010 to about 0.050 inches or from about 10 mils to 50 mils. A caliper of from about 15 to 25 mils is most typically employed.

While any suitable polypropylene polymer may be employed, the most preferred polymer is isotactic polypropylene having a melt index in the range of from about 0.3 to 4, with a melt index of about 1.5 being typical. The polyethylene employed may be HDPE, LLDPE, LDPE or MDPE, mixtures thereof or a polyethylene with bimodal molecular weight distribution. Polypropylene is sometimes referred to hereafter as "PP".

The inventive compositions from which the crack resistant articles are made do not include coupling agents such as maleic anhydride containing polypropylene as further described herein, but may optionally include other components which do not alter the basic and novel characteristics of the crack-resistant plates. For example, nucleants such as sodium benzoate in amounts detrimental to crack resistance are to be avoided.

In a still further aspect of the invention there is provided a method of making a microwaveable mineral-filled polypropylene food contact article comprising preparing a melt-compounded composition comprising from about 40 to about 90 percent by weight of a polypropylene polymer and from about 10 to about 50 percent by weight of a mineral filler and optionally an effective amount of an odor-reducing compound. The melt-compounded composition exhibits a relative aroma index, relative to a corresponding composition consisting essentially of polypropylene and mica of less than about 0.75. The composition is extruded into a sheet and formed into a suitable food contact article. Preferably, the article consists essentially of polymer and mineral filler and excludes such components as excess anti-oxidants and the like.

Suitably the basic inorganic or organic compounds are selected from the group consisting of calcium carbonate, sodium carbonate, potassium carbonate, barium carbonate, aluminum oxide, sodium silicate, sodium borosilicate, magnesium oxide, strontium oxide, barium oxide, zeolites, sodium phosphate, potassium phosphate, magnesium phosphate, mixtures of silicon dioxide with one or more of the following oxides: magnesium oxide, calcium oxide, barium oxide, and mixtures of these or other basic inorganic or organic compounds such as sodium stearate, calcium stearate, potassium stearate, sodium citrate, potassium citrate, and mixtures of these basic organic compounds.

The function of the basic inorganic compound or organic compound is to minimize the formation of odor-causing compounds in the mineral-filled polyolefin composition and thus provide products with food contact compatible olfactory properties for consumer use. In this connection, the amount of the basic inorganic compound or organic compound added is controlled to be sufficient to reduce formation of decomposition products to sufficiently low levels to provide containers and plates with suitable food contact compatible olfactory properties. Suitably 5 to 15 weight percent of the container comprises the basic inorganic compound, advantageously about 8 to 12 percent. When the basic organic compounds are used, lower quantities are required, suitably from about 0.5 to 2.5 weight percent, advantageously 1.0 to 1.5 percent. Coupling agents and pigments may be utilized. Maleic anhydride and acrylic modified polypropylenes are suitable coupling agents for some embodiments.

Advantageously, the sheet is formed by an extrusion process utilizing a compounded polymer/mica basic inorganic compound or basic organic compound mixtures. The final extrusion process renders a sheet with excellent thermal properties, cut resistance, and food contact compatible olfactory properties.

Mica is easily cleaved into thin, relatively regular, flexible yet strong sheets (leaf-like flakes) with thickness in the range of half a micron and aspect ratio as high as 300. Mica is much softer than other inorganic fillers (wollastonite, glass) yet only slightly harder than talc. Mica has a slippery tactile feel and low abrasiveness relative to other common inorganic fillers.

The reinforcement effect at 40 weight percent mica is equivalent to that of 30 weight percent glass fiber. Hard inorganic fibrous fillers such as glass (various lengths) and wollastonite (acicular structures) have drawbacks in some respects such as abrasiveness and are prone to fracture degradation during conventional melt processing. Other fibrous (organic) fillers are derived from wood and vegetable sources and are not suitable for use in the manufacture of the containers of this invention since the organic fillers, when used in substantial amounts, tend to degrade during processing and they are also moisture sensitive.

In some applications it may be preferred to treat the mineral and/or basic inorganic compounds prior to using them in the inventive articles. A suitable compound for this treatment is amino-silane; sometimes referred to as a "coupling" agent.

Suitable basic inorganic and organic compounds used in the process include: calcium carbonate, sodium carbonate, sodium hydroxide, potassium carbonate, barium carbonate, aluminum oxide, sodium silicate, sodium borosilicate, magnesium oxide, strontium oxide, barium oxide, zeolites, sodium phosphate, potassium phosphate, magnesium phosphate, mixtures of silicon dioxide with one or more of the following oxides: magnesium oxide, calcium oxide, barium oxide, and mixtures of these or other basic inorganic or organic compounds such as sodium stearate, calcium stearate, potassium stearate, sodium citrate, potassium citrate, and mixtures of these basic compounds.

In the case where microwaveability is desired for a plastic disposable food contact article, the not so perfect solution has been the use of relatively expensive high heat modified polystyrene based or heat resistant materials (e.g., unfilled PPO and SMA engineering resins), where PPO refers to polyphenylene oxide and SMA refers to styrene-maleic anhydride copolymer.

Mica or another mineral filler and the basic inorganic compound or the basic organic compound filled polypropylene is compounded by pre-blending the polypropylene in pellet or flake form with mica powder and the basic inorganic compound or the basic organic compound powder and other additives (color concentrates, pigments, antioxidants, lubricants, nucleating agents, antistatic agents, etc.). This mixture is conveyed into the feed section addition point of a twin screw compounding extruder, or compounded in a Banbury-type mixer to provide a melt-processed polyolefin composition. Alternatively, the components are advantageously fed separately into the same or different points of addition, using combinations of volumetric and/or gravimetric (i.e., loss in weight type) feeders as further described herein.

For white pigmentation, titanium dioxide is preferred due to combination of brightness, and opacity, as well as stability during processing and final use. Surface treatment may be optionally used to further enhance wetting, dispersion, compatibility with matrix resins whereas the titanium dioxide forms may be of the rutile or anatase type. Alternate white pigments may also consist of calcined clay or blends of calcined clay with titanium dioxide. For black pigmentation, carbon black is preferred due to a combination of desirable characteristics such as blackness, and dispersibility, the latter of which can be carefully controlled by choice of particle size and surface chemistry. Carbon black is amorphous carbon in finely divided form which is made by either the incomplete combustion of natural gas (channel black) or by reduction of liquid hydrocarbons in refractory chambers (furnace black).

A twin screw extruder provides sufficient mixing action to effectively cause the wetting and dispersion of the filler into the polymer matrix. The twin screw extruder may be of the co-rotating or counter-rotating type, where each type is equipped with different screw flight elements which are appropriate for the feed, mixing, and melt metering zones. The discharge zone normally consists of a strand die where the exiting molten material strands are quenched in a circulating water bath followed by knife cutting into pellets. In a particularly preferred embodiment, a Banbury-type mixer is used for compounding the resin, mica and basic compound as further described herein.

Low molecular weight additives such as waxes, fluorinated polymers, and other specialty lubricants are suitably used as process aids to reduce the melt viscosity and improve throughput. Polyethylene resin may also be added to the blend. Other additives may include nucleating agents and antistatic agents. Antioxidants may be added in small amounts, generally less than one weight percent, to minimize shear and thermal degradation of the polypropylene during the extrusion and forming processes as well as to promote the chemical stability of the sheet prior to and during final article use. Suitable antioxidants are advantageously selected from the group of phenolics and phosphites and blends thereof. These are produced by Ciba-Geigy and General Electric Corporation. Plastic sheet extrusion equipment is suitable for the manufacture of multilayered or single layered mica or other mineral filler and the basic inorganic or organic compound filled sheets of a polyolefin selected from the group consisting of polypropylene, polypropylene/polyethylene copolymer or blend, and mixtures of these. Melt strength of the sheets is improved when mica is used as a filler since geometry of the mineral in the form of high aspect ratio flakes serves to provide "interparticle connectivity" or physical cross-linking. The food contact compatible olfactory properties are enhanced when in addition to the mica, basic inorganic compounds or organic compounds such as calcium carbonate, sodium carbonate, potassium carbonate, barium carbonate, aluminum oxide, sodium silicate, sodium borosilicate, magnesium oxide, strontium oxide, barium oxide, zeolites, sodium phosphate, potassium phosphate, magnesium phosphate, mixtures of silicon dioxide with one or more of the following oxides: magnesium oxide, calcium oxide, barium oxide, and mixtures of these or other basic inorganic or organic compounds such as sodium stearate, calcium stearate, potassium stearate, sodium citrate, potassium citrate, and mixtures of these are mixed with mica or other mineral filler and the polyolefin to produce the containers of this invention. Exemplary inorganic materials which may also be employed as a primary mineral filler include talc, barium sulfate, calcium sulfate, magnesium sulfate, clays, glass, dolomite, alumina, ceramics, calcium carbide, silica and so on. Many of these materials are enumerated in the *Encyclopedia of Materials Science and Engineering*, Vol. #3, pp. 1745–1759, MIT Press, Cambridge, Mass. (1986), the disclosure of which is incorporated herein by reference.

Mineral fillers are sometimes referred to by their chemical names. Kaolins, for example, are hydrous alumino silicates, while feldspar is an anhydrous alkali, alumino silicate. Bentonite is usually an aluminum silicate clay and talc is hydrated mangesium silicate. Glass, or fillers based on silicon dioxide may be natural or synthetic silicas. Wollastonite is a calcium metasilicate whereas mica is a potassium alumino silicate. Mineral fillers are further discussed below. As noted above, clays may be employed as a primary filler. The two most common of which are kaolin and bentonite. Kaolin refers generally to minerals including kaolinite which is a hydrated aluminum silicate ($Al_2O_3.2SiO_2.2H_2O$) and is the major clay mineral component in the rock kaolin. Kaolin is also a group name for the minerals kaolinite, macrite, dickite and halloysite. Bentonite refers to hydrated sodium, calcium, iron, magnesium, and aluminum silicates known as montmorillonites which are also sometimes referred to as smectites. A large number of siliceous materials may also be employed as a primary filler. These materials include diatomite, perlite, pumice, pyrophillite, silica, and talc. These minerals typically consist of an alkali metal oxide or alkaline earth element oxide, and silicon dioxide together with a minor amount of water and other elements. Talc, for example, includes from about 25% to about 35% MgO, 35–60% $SiO_2$ and about 5% $H_2O$. These materials are further described below. Diatomite or kieselguhr is a sedimentary material formed by centuries of life cycles of aquatic diatoms, a simple plant in the algae family with an opaline silica cell wall. Thousands of species of diatoms have flourished and continue to do so in both marine and lacustrine environments. Fossilized skeletal remains of diatoms in commercial quantities are found in many parts of the world. Perlite is believed to result from hydration of volcanic glass or obsidian. Generally, hydration is about 2–5%; this water content is important to the expansibility of the perlite, influencing melting point and supplying expansion steam.

The rapid expansion of dissolved gases in silica lavas during volcanic eruptions produces the light density pumice or pumicite. The finer pumicite particles are transported by wind away from the source volcano, whereas pumice accumulates closer to the vent.

The hydrous aluminum silicate, pyrophilite, is formed by hydrothermal metamorphism of acid tuffs or braccias.

Silica sand is frequently obtained from the weathering of quartz-containing rock. Decomposition and disintegration of the rock with decomposition of other minerals leaves a primary quartz sand that has been concentrated by water movement. Induration of sands to sandstone results in another source for silica sand. Amorphous silica, or more properly cryptocrystalline or microcrystalline silica, is formed by the slow leaching of siliceous limestone or calcareous chert. Talc is formed by the metamorphic (hydrothermal) alteration of magnesium silicates such as serpentine, pyroxene or dolomite.

The siliceous fillers are generally inert in most applications as shown by pH values in the range from about 6–10.

Sulfate minerals, such as gypsum and barite may likewise be employed as a primary filler. Gypsum is the name given to the mineral that consists of hydrous calcium sulfate ($CaSO_42H_2O$), and also to the sedimentary rock that consist primarily of this mineral. In its pure state, gypsum contains 32.6% lime (CaO), 46.5% sulfur trioxide ($SO_3$), and 20.9% water. Single crystals and rock masses that approach this theoretical purity are generally colorless to white, but in practice, the presence of impurities such as clay, dolomite, silica and iron imparts a gray brown, red or pink color to the rock.

There are three common varieties of gypsum: selenite, which occurs as transparent or translucent crystals or plates; satin spar, which occurs as thin veins (typically white) of fibrous gypsum crystals; and alabaster, which is compact, fine-grained gypsum that has a smooth, even-textured appearance. Most deposits or rock gypsum that are suitable for industrial purposes are aggregates of fine to coarse gypsum crystals that have intergrown to produce a thick, massive sedimentary rock unit that is 90–98% gypsum. Alabaster is highly prized because of its uniformly fine particle size, but the more common deposits of rock gypsum consisting of coarser-grained selenite can generally be crushed and ground to produce a suitable filler and coating material.

Gypsum has a hardness of 2 on the Mohs scale, and can be scratched with the fingernail. Large rock masses are easily crushed and ground to a fine powder. The specific gravity of gypsum is about 2.31 and the refractive index is about 1.53. Gypsum is slightly soluble in water but it is an inert substance that resists chemical change. The oil-absorption capacity of gypsum is fairly low (0.17–0.25 $cm^3g^{-1}$).

Raw or crude gypsum is one of the forms used as fillers and coatings, but for some purposes calcined or deadburned gypsum is desired. In calcining, the gypsum is heated to abut 120–160° C. to drive off free water and partially remove the water of crystallization. The calcined material or stucco, has a chemical composition of $CaSO_4.½H_2O$, and it readily takes up water. Calcination at higher temperatures (500–725° C.) results in a product called deadburned gypsum, which has a composition of $CaSO_4$.

Anhydrite, a sulfate mineral and rock that is closely associated with gypsum in nature and has minor uses as a filler, in anhydrous calcium sulfate ($CaSO_4$) containing 41.2% CsO and 58.8% $SO_3$. It is typically fine grained (like alabaster), and occurs in thick, massive sedimentary rock units. Anhydrite usually is white or bluish gray when pure, but it may be discolored by impurities. Anhydrite has a hardness of 3.5, a specific gravity of 2.98, and a refractive index of 1.57–1.61.

Thus, fillers commonly include:

Barium Salt
Barium Ferrite
Barium Sulfate
Carbon/Coke Power
Calcium Fluoride
Calcium Sulfate
Carbon Black
Calcium Carbonate
Ceramic Powder
Chopped Glass Clay
Continuous Glass
Glass Bead
Glass Fiber
Glass Fabric
Glass Flake
Glass Mat
Graphite Powder
Glass Sphere
Glass Tape
Milled Glass
Mica
Molybdenum Disulfide
Silica
Short Glass
Talc
Whisker Particulate fillers, besides mica, commonly include:
Glass
Calcium carbonate
Alumina
Beryllium oxide
Magnesium carbonate
Titanium dioxide
Zinc oxide
Zirconia
Hydrated alumina
Antimony oxide
Silica
Silicates
Barium ferrite
Barium sulphate
Molybdenum disulphide
Silicon carbide
Potassium titanate
Clays Whereas fibrous fillers are commonly:
Whiskers
Glass
Mineral wool
Calcium sulphate
Potassium titanate
Boron
Alumina
Sodium aluminum
Hydroxy carbonate Suitably the extruded sheet includes coloring agents for aesthetic appeal, preferably titanium dioxide, carbon black, and other opacifying agents in the range of 0.5–8 weight percent based on total composition, preferably 1.5 to 6.5 weight percent. The extruded sheet comprises minor amounts of other additives such as lubricants and antioxidants. These articles of manufacture may be suitably colored with pigments or dyes. Pigments are defined as small insoluble organic or inorganic particles dispersed in the resin medium to promote opacity or translucency. Usual pigments include carbon black, titanium dioxide, zinc oxide, iron oxides, and mixed metal oxides. Dyes are organic and soluble in the plastic, and may be used alone or in combination with pigments to brighten up pigment based colors. All such colorants may be used in a variety of modes which include dry color, conventional color concentrates, liquid color and precolored resin.

Aroma Profile Test Method

The Sensory Analysis Center at Kansas State University has developed a profiling protocol in which a highly trained panel identifies specific odors and rates their intensity. The intensity scale is a 15-point "universal" scale of the type typically chosen for sensory studies, where 1 is barely perceptible or threshold and 15 is extremely strong. If an attribute or odor component is not listed in the tables which follow, it means it is not present and would score a 0. The panel members are selected on the basis of a series of screening tests that include basic taste, odor recognition, taste intensity recognition, taste intensity ranking, and a personal interview to evaluate availability and personality traits. Training, which includes the fundamental sensory principles and all aspects of the profile technique, is done over a 4–12 month period.

The panelists work as a group to arrive at a description of the product. Individual results are compiled by the panel leader and discussion follows in which disagreements are discussed until a consensus is reached on each component of the profile, Reference materials and more than one session usually are required in order to reach the consensus.

The procedure for resin is to place 40 ml. of resin in a 340 ml. glass brandy snifter, which is covered with a watch glass. Sheet samples are cut into two 2"×2" sections and placed in the same size brandy snifter. In testing, panelists found that some samples had initial odor components that disappeared rapidly. Therefore an initial impact and a sustained impact were evaluated for each sample. The initial impact was judged immediately after the watch glass had been removed; the sustained impact was judged 10 seconds after the watch glass had been removed. Typical results are shown in the Table 1 below for Low Odor and High Odor Compositions. "Low" odor formulations were produced using lower melt processing temperatures in compounding and adding 10% calcium carbonate to the formulation.

TABLE 1

High Odor vs. Low Odor Polypropylene Composites: Effect of Adding 10% $CaCO_3$
ODOR PROFILE FOR COMPOUNDED RESIN

| Resin Impact | | | Consensus Odor Profile on Resin (Kansas State University Sensory Analysis Center) | | | | | | | |
|---|---|---|---|---|---|---|---|---|---|---|
| Resin | Initial | Sustained | Petroleum | Pungent | Musty | Scorched | Medicinal | Sweet | Waxy | Soapy |
| High Odor | 9.0 | 3.5 | 8.0 | 4.0 | 7.0 | 3.5 | 3.0 | | | |
| Low Odor | 5.5 | 2.5 | 2.5 | | 4.5 | | | 1.5 | 2.0 | 4.5 |

TABLE 1-continued

| |
|---|
| High Odor Resin |
| 65.63% Polypropylene |
| 30% Mica |
| 2.5% Coupling Agent |
| 1.87% Pigment |
| Low Odor Resin |
| 55.63% Polypropylene |
| 30% Mica |
| 10% $CaCO_3$ |
| 2.5% Coupling Agent |
| 1.87% Pigment |

High Odor and Low Odor compositions were compounded utilizing the process melt temperatures indicated in the first column of Table 2 and formed into sheets as described above. Thermoformed sheet was evaluated for aroma profile.

TABLE 2

ODOR PROFILE FOR SHEET FORMED FROM COMPOUNDED RESIN AT TWO TEMPERATURES

| | Sheet Impact | | Consensus Odor Profile on Sheet | | | | | | | |
|---|---|---|---|---|---|---|---|---|---|---|
| Resin | Initial | Sustained | Petroleum | Pungent | Musty | Scorched | Medicinal | Sweet | Waxy | Soapy |
| High Odor 370° F. | 12.0 | 6.0 | 10.0 | 8.0 | 7.5 | 4.5 | 4.0 | | | |
| High Odor 459° F. | 11.0 | 8.0 | 7.5 | 7.5 | 6.0 | 3.5 | 2.0 | | | |
| Low Odor 371° F. | 5.5 | 2.0 | 3.5 | | 4.0 | | | 2.0 | 2.5 | 2.5 |
| Low Odor 460° F. | 5.5 | 2.0 | 3.0 | | 3.5 | | | 2.0 | | 3.5 |

The foregoing data demonstrates that: when a basic moiety containing compound was added to the mica polyolefin composition, a resin was produced having suitable food contact compatible olfactory properties. Significant decreases in the initial and sustained odors were observed and the scorched, pungent, and petroleum aroma components were removed or greatly reduced and these undesirable components seem to be replaced with sweet, waxy, and soapy aroma components.

When compounded pellets are subjected to sheet extrusion, those without calcium carbonate increase in the disagreeable components (pungent and petroleum) and increase in the initial and sustained odor output with subsequent processing. In contrast, when pellets contain calcium carbonate, no increase in undesirable aroma components was observed and no increase in the initial or sustained odor was produced with subsequent processing. Test panel data correlated well with analytical techniques as can be seen from the discussion and examples which follow.

C8/C9 Ketones

The precise nature of the odor causing compounds in polypropylene/mica compositions is not known; however, it has been found that undesirable odors correlate well with eight carbon (C8) and nine carbon (C9) alkyl ketones as described hereinafter, and may be associated with such compounds. A Likens-Nickerson steam/methylene chloride extraction technique was used to extract possible odor causing compounds from polypropylene/mica compositions and produce a concentrate. The extraction was performed until complete. The concentrate was analyzed through gas chromatography/mass spectrometry to produce chromatograms. The C8/C7 ratios referred to hereinafter are ratios of the abundance at the peaks assigned to be 4-methyl-2-heptanone to the abundance at the peak assigned to be 4-heptanone as measured by Likens-Nickerson extraction followed by gas chromtography/mass spectrometry.

Generally, "low odor" compositions reduce concentration of C8 and C9 ketones over "high odor" compositions by ⅔ with ⅕ being typical and 1/10 being preferred. Thus, in general, melt-compounded compositions in accordance with the invention have extractable concentrations of C8 and C9 alkyl ketones of less than about 3.5 ppm (weight) with less than 2 ppm being typical and less than 1 ppm being particularly preferred. Thus, the C8/C7 ratio can be used as an alternative indicator of desirable olfactory characteristics. Typically, "low odor" compositions in accordance with the invention have a C8/C7 ratio at least five times less than high odor compositions with at least ten times less being typical. In preferred compositions according to the invention, C8/C7 ratios as measured by Likens-Nickerson extraction followed by gas chomatography/mass spectrometry are generally less than about 0.5 or so as is seen from in the examples which follow. C8/C7 ratios of less than about 0.3 are typical and C8/C7 ratios of less than about 0.1 are particularly preferred. The articles of the invention and the pellets from which they are made are further characterized by an odor index which is determined by commercially available equipment in accordance with the procedure detailed below.

Odor Index

Melt processed compositions produced in accordance with the present invention, particularly extruded pellets from which articles such as plates and bowls are made, characteristically exhibit relatively low odor as opposed to conventionally formulated mineral/polypropylene compositions. Generally the odor index (as defined herein) is less than about 0.75, with less than or equal to about 0.6 being preferred. In general, the lower the odor index, the lower the odor intensity of the mineral-filled/polypropylene pellets.

Less than or equal to about 0.5 is most preferred with a practical lower limit believed to be somewhere around 0.1 or so. Thus, in accordance with the invention, melt compositions will generally have an odor index of less than about 0.75 and typically from about 0.60 to about 0.1.

The odor index of a particular melt-processed composition is readily determined using conventional materials and equipment.

The odor index is defined as the arithmetic average of all sensor integrals for a given mineral-filled polypropylene sample including both a primary mineral filler and calcium carbonate or other odor suppressing compound divided by the arithmetic average of all integrals for a filled polypropylene sample including a primary mineral filler, but no odor suppressing basic compound, or in equation form:

$$\text{Odor Index} = \frac{\text{average readings of pellets including a primary mineral filler and calcium carbonate or other odor suppressing compound}}{\text{average readings of pellets including mineral filler only without an odor suppressing basic compound}}$$

A commercially available "electronic nose" aroma scanning device is used. Typically, such devices utilize a plurality of conductivity sensors to determine the odor of a sample. The particular device used in the discussion which follows uses 32 sensors whose response is integrated over time. The various integrals are averaged for each sample and the single value is used in the numerator and the denominator of the above equation.

A sample of the present invention is described in Table 3 and following.

TABLE 3

Index Numerator Composition

| Component | Manufacturer | Product Number | Amount (Wt. Percent) |
|---|---|---|---|
| Polypropylene | Exxon | Escorene 4772 | 55.63 |
| Mica | Franklin Industrial Minerals, Inc. | L-140 | 30.0 |
| Calcium Carbonate | Huber | Q-325 | 10.0 |
| Coupling Agent | Aristech | Unite NP-620 | 2.5 |
| Titanium Dioxide | Tioxide | TR-23 | 1.87 |

The above components were extruded on a 90 mm Berstorff Co-Rotating Twin Screw Extruder with underwater pelletizing under the following conditions: 200 rpm screw speed with the following set temperature profile:

Zone 1—510° F.
Zone 2—485° F.
Zone 3—400° F.
Zone 4—380° F.
Zone 5—380° F.
Zone 6—380° F.
Head Flange—425° F.
Screen Changer—425° F.
Die—440° F.
Throughput appx. 900 LB/HR to produce pellets, the odor values of which are used in the numerator of the above equation.

The preferred instrument to perform the aroma intensity measurements is an AromaScan® model A32 (AromaScan, Hollis, N.H., USA). This instrument employs a dynamic head space type of measurement, in which nitrogen gas flows through a sample vial and carries aroma volatiles to the sensors. All pellet samples are analyzed in triplicate with the final results averaged to minimize measurement noise. In the illustrations which follow, The "Acquisition Parameters" method of the instrument is set with a sampling interval of 1 and a detection threshold of 0.2. The "Multisampler-SP" method of the instrument sets the platen temperature (100° C. for the examples herein). Two other temperatures (115° C. and 125° C.) are automatically set. The Multisampler-SP method is also used to set the parameters in Table 4 to measure aroma intensity.

TABLE 4

AromaScan ® Settings

| | |
|---|---|
| Sample Equilibration Time: | 5 minutes |
| Vial Size: | 22 ml |
| Mix Time: | 0 |
| Mix Power: | 1 |
| Relative Humidity: | 10% |
| Sampling Time: | 4 minutes |
| Wash Time: | 5 minutes |
| Data Collection Time (minutes): | 19 |
| Time Between Injections (minutes): | 20 |

In the recognition window, start and end are set at 1. In addition to the foregoing, the "Vial Pressurization Control" is set at 20 kPa, the "Vial Needle Flow" is set at 50 ml/min nitrogen; "Transfer Line Flow" across the sensors, between, before and after samples is set at 150 ml/min. All gas flows are for dry nitrogen.

A response of each of the 32 sensors of the AromaScan® machine is integrated over a time interval of 55–150 seconds. The initial 55 seconds is allowed to let humidity/moisture exit the system to a great extent before integration is started. The 150 second integration end time was chosen to allow the sensor signals to return to baseline, at which time all significant signal has been integrated. The various signals seen after 150 seconds are insignificant in terms of the odor measurement.

Using the foregoing procedure and composition, 2.0 grams of compounded polymer pellets are weighed and placed in the 22 ml, crimp top, septum capped vials and analyzed automatically by the instrument. A denominator, or reference sample is prepared as described in connection with Tables 7 and 8, except that no calcium carbonate is used; i.e. the sample has 65.63% polypropylene. Through the use of an automated instrument, the odor intensity of the melt-compounded pelletized composition can be reduced to a single value. While the foregoing sets forth a particular and preferred method of determining the odor intensity index, it may also be possible to employ other instruments consistent with this protocol since such instruments are readily available. If such alternative instrument is employed the standard composition detailed above should be used to ensure that calibration is proper. As noted, the reference or denominator composition is prepared by substituting polypropylene for the calcium carbonate (or other basic compound) of the numerator composition.

EXAMPLES 1–9

A series of resin compositions and sheet products were prepared in accordance with the discussion above and characterized by C8/C7 ketone ratio and odor panel testing. Variables included calcium carbonate addition, process atmosphere (air or nitrogen) and process melt temperature. Results appear in Table 5 for examples 1 through 9.

TABLE 5

$CaCO_3$ Effect of Process Conditions and Compositions on Odor of PP/Mica Composites

| Example | Type (Banbury or Extruded Sheet) | Process Atmosphere (Air/$N_2$) | $CaCO_3$ (Yes/No) | Process Melt Temperature | $C_8/C_7$ Ketone Ratio | Odor Panel Data: Sustained (Total Intensity) | Odor Panel Data: "Scorched" Odor Profile Component Intensity |
|---|---|---|---|---|---|---|---|
| 1 | Brabender Banbury Compounded | Air | Yes | 370° F. | 0.055 | 2.0 | 0 |
| 2 | Brabender Banbury Compounded | Air | Yes | 460° F. | 0.6 | 4.0 | 5.0 |
| 3 | Sheet | $N_2$ | Yes | 460° F. | 0.3 | | |
| 4 | Brabender Banbury Compounded | Air | Yes | 460° F. | 0.6 | 4.0 | 5.0 |
| 5 | Sheet | Air | Yes | 370° F. | 0.15 | 2.0 | 0 |
| 6 | Sheet | Air | No | 370° F. | 1.3 | 6.0 | 4.5 |
| 7 | Sheet | Air | Yes | 400° F. | — | 5.0 | 2.5 |
| 8 | Sheet | Air | No | 460° F. | 0.9 | 8.0 | 3.5 |
| 9 | Sheet | Air | Yes | 460° F. | 0.7 | 2.0 | 0 |

See discussion above for $C_8/C_7$ ketone ratio, olor; Kansas State University Odor Panel Profile.
Extruded Sheet was prepared using a single screw extruder with pre-compounded resin made by a twin screw process.

The resins of Examples 1, 2 and 4 were prepared on a Brabender device (C.W. Brabender, model EPL2V5502) with a Banbury mix head (model R.E.E.6, 230v, 11*a*) with a mixing time of 5–10 minutes.

The sheet samples, Examples 3 and 5 through 9, were prepared from precompounded resin pellets extruded under the conditions shown in Table 6.

TABLE 6

Sheet Extrusion Conditions for PP/Mica Pilot Extruder

| CONDITIONS | ACTUAL | SET POINT |
|---|---|---|
| Barrel Zone 1 (° F.) | 354–378 | 360–375 |
| Barrel Zone 2 (° F.) | 366–410 | 370–410 |
| Barrel Zone 3 (° F.) | 371–460 | 370–460 |
| Adapter temp (° F.) | 359–460 | 370–460 |
| Feed Block Temp (° F.) | 370–468 | 370–460 |
| Die Zones 1–3 temps (° F.) | 368–462 | 370–460 |
| Extruder RPM | 110 | 110 |
| Drive Amperes | 15–23 | — |
| Melt Pressure (psi) | 1050–1850 | — |
| Die Pressure (psi) | 745–910 | — |
| Line Speed (FPM) | 8.25–9.74 | — |
| Chill roll temp. (° F.) | 130 | — |

The odor of PP/mica composites (pellets or sheet) is affected by temperature, atmosphere, and by the addition of a basic filler such as $CaCO_3$. The C8/C7 ketone ratio is consistent with the odor panel data and shows that offensive odor components decrease with:

Using lower processing temperatures

Using a base such as $CaCO_3$ as a buffering agent

Processing under inert atmosphere such as $N_2$.

EXAMPLES 10–13

Particularly preferred, low odor compositions are prepared by way of a sequential process in a Banbury mixer at relatively low temperatures. It has been found that melt compositions prepared in a sequential Banbury process exhibit superior stiffness as measured by flexural modulus properties and low odor. In a sequential process in accordance with the invention, two feed steps are used in order to minimize the time heated or molten polypropylene is in contact with the mica or other mineral filler.

TABLE 7

Comparison of Compounding Processes

| COMPOUNDING PROCESS | Compound Flexural Modulus (Tangent), PSI | 9" Plate Rigidity (g/0.5") | Odor Index; Approximate (Compound) |
|---|---|---|---|
| Twin Screw Example 10 | 718,000 | 417 | 0.625 |
| Banbury (non-sequential) Example 11 | 591,000 | 378 | 0.375 |
| Banbury (sequential, 1 min. pre-heat) Example 12 | 708,000 | 416 | 0.41 |
| Banbury (Sequential, 2 min. premelt) Example 13 | 635,000 | 352 | 0.3875 |

Table 7 shows compound flexural modulus (as measured by ASTM method D 790–95a), corresponding plate rigidity, and aroma intensity index on four indicated compounding processes designated as Examples 10–13. In the case of twin-screw (Example 10), high modulus is obtained but with higher odor with relatively low throughput, in the range of 900 lb/hr, which is less than half the output of Banbury compounding processes (utilizing a Stewart-Boiling Banbury Mixer with batch sized in the range of 150–200 lb) listed herein. In the case of non-sequential Banbury process, low modulus is obtained with corresponding low plate rigidity with lower odor and high throughput. In the last two cases corresponding to sequential Banbury processes designated as "1 min. pre-heat" and "2 min. pre-melt", the short 1 minute preheat case (Example 12) is preferred because it gives high compound modulus and high plate rigidity (comparable to twin screw case) with benefits of both low odor and high throughput, in excess of 2000 lb/hr.

The twin screw formulation in the above table contains PP/30% mica/10% CaCO3 with 2.5% coupling agent (maleic anhydride modified PP grade Aristech Unite NP–620) and no polyethylene. The formulation corresponding to all three listed Banbury processes in above table contain PP/30% mica/10% CaCO3/0.5% Ti02/4%LLDPE with no coupling agent where such ingredients have the following sources and grades: Mica=Franklin Minerals L-140, $CaCO_3$=Huber Q325, PP=Exxon Escorene PP4772, LLDPE=Novapol Novachemical G1-2024A.

The Banbury "non-sequential" case (Example 11) in Table 7 corresponds to adding all ingredients together with a total compounding time of about 4.5 minutes followed by conversion of the batch (having temperature of 430° F.) to pellets using a continuous 10" single screw extruder equipped with one 30 mesh and one 20 mesh screen, and an underwater pelletizing die assembly, with a pelletizing temperature in the range of 455–470° F.

The Banbury "sequential 2 min premelt" case (Example 13) in Table 7 corresponds to a 2 minute period for melting the PP/LLDPE mixture (in the presence of $CaCO_3$ and $TiO_2$) to a maximum temperature of about 350° F., followed by adding mica and thereafter mixing for a period of about 105 sec to achieve a batch temperature of about 430° F., followed by conversion to pellets with a pelletizing temperature of about 460° F. The Banbury "sequential, 1 min pre-heat" case (Example 12 in Table 7 corresponds to about a 1 minute period for presoftening the PP/PE mixture (in the presence of $TiO_2$, or alternatively adding the $TiO_2$ with the mica and calcium carbonate) to a maximum temperature of about 260° F., followed by adding the mica/$CaCO_3$ mixture and thereafter mixing to achieve a batch temperature of about 425° F., followed by conversion to pellets with a pelletizing temperature of about 425° F. In this preferred mode, it has been found that polymer preheating aids in preserving compound stiffness (required for rigid articles of manufacture) and intimate contact of mica with odor suppressing agent ($CaCO_3$) aids the production of low odor material.

Pellets from the above mentioned Banbury compounding processes were subsequently extruded at 370° F. as cast sheets in the range of 17–18 mil. Sheet line conditions also included a screw RPM value of 100, a chill roll temperature of about 130° F., drive amperage value of about 22, melt pressure of about 2000 psi, die pressure of about 970 psi, and a line speed of about 7 ft/min. Plates were subsequently vacuum thermoformed using a female mold and trimmed and tested for rigidity.

Physical Properties, Heat Resistance and Food Contact Suitability

TABLE 8

MICROWAVE COOKING TEST RESULTS FOR PLATES J AND S

| | PLATE TYPE | |
|---|---|---|
| FOOD TYPE | J | S |
| Donut | Pass | Sugar glazing sticks |
| Broccoli/cheese | Pass | Significantly deforms |
| Pepperoni pizza | Pass | Moderate deformation, Staining |
| Barbecue pork | Slight stain | Significant stain/warpage |
| Pancake/syrup | Pass | Significant warpage |
| Beans & pork | Pass | Significant warpage |

TABLE 8-continued

MICROWAVE COOKING TEST RESULTS FOR PLATES J AND S

| | PLATE TYPE | |
|---|---|---|
| FOOD TYPE | J | S |
| Butter | Slight warpage | Significant warpage |
| Bacon | Moderate warpage Localized melting, no leak | Significant warpage Rubbery plate flows and Sticks to glass tray |

Microwaveability

Fort James Corporation (J) plate specimens of this invention and plates manufactured by Solo Cup Company (S) were tested in the microwave (Samsung model MW 8690) with a variety of foods. The highest power setting (10) was used in all cases and cooking/heating times and procedures corresponded to food manufacturer instructions on the packages. Most tested foods were of the frozen microwaveable type and were placed in a semi-thawed state directly on plates prior to cooking. When appropriate, a loose covering of wax paper was employed during the cooking process. After cooking, the plates were gently washed with warm water and inspected. The following are the detailed test results which are also summarized in above Table 8.

TEST #1 RESULTS—Sugar Glazed Donut

J A large, oval shaped sugar glazed plain donut was microwaved on the plate of this invention for 60 seconds. The sugar glazing melted, bubbled, and flowed on the plate. The boiling sugar and grease mixture caused the bottom of the plate to feel very warm but the plate exhibited no warping, no staining, no softening, and no soak-through. The plate was cool enough to be safely handled. The residue of the donut was easily washed off and the appearance of the used plate was excellent.

S The bottom of the plate got hot and slightly deformed with no soak-through, however, sugar stuck to the plate.

TEST #2 RESULTS—Broccoli With Cheese Sauce

J Green Giant 10 oz. Broccoli with cheese sauce was removed from the flexible pouch and heated for five minutes in the microwave on the plate with loose covering of wax paper. The cheese melted and bubbled on the plate without sticking. The plate bottom was warm, but no soak-through and no loss of dimensional stability was observed. After washing, no staining-was observed and the appearance of the used plate was excellent.

S The plate bottom got hot and significantly deformed with no soak-through.

TEST #3 RESULTS—Pepperoni pizza

J Tombstone 7 oz. Pepperoni pizza was cooked on an uncovered plate for 4 minutes. The cheese melted and started bubbling about halfway through the test. The molten cheese mingled with the hot liquid fat extruded from the pepperoni and dripped on the sides of the crust onto the plate. No sticking, no soak-through, no staining, and no loss in plate dimensional stability was observed and the appearance of the used plate was excellent.

S The plate bottom got hot and moderately deformed with no soak-through. The greasy reddish stain from oil in pepperoni could not be completely washed off.

TEST #4 RESULTS—Microwave Kid Meal:

Pork Rib Patties, Barbecue Sauce, Fries, Honey Corn Bread

J A quick meal preparation simulation test was conducted using a Swanson 7.2 oz. microwave kids' meal with ingredients consisting of partially cooked boneless pork rib patties, barbecue sauce, fries, and honey corn bread. The food was transferred from the compartmented tray onto the plate. Sauce was spooned on top of the pork meat and was allowed to drip on the sides of the patties and onto the plate. The cornbread batter was spooned out and was placed on the plate next to the fries. The food was loosely covered with wax paper and cooked for 3.5 minutes. Examination after microwaving showed that the cornbread was fully cooked and there was no sticking or damage to the plate. The fries and pork meat with sauce caused no soak-through and no loss in plate dimensional stability. Washing of plate revealed the presence of slight staining from barbecue sauce. Overall, the appearance of the used plate was very good.

S The plate bottom deformed mainly from pork meat with considerable staining from the barbecue sauce without soak-through.

TEST #5 RESULTS—Beans With Pork and Tomato Sauce

J Beans with pork and tomato sauce (8 oz. Can) were placed on the plate, covered with wax paper and heated for 2 minutes near boiling. The bottom of the plate got hot, but the rim was cool to touch. The hot plate bottom exhibited no bulging and also, when the hot food plate was handled by the rim there was no perceived loss in dimensional stability. No soak-through, no warping and no staining was observed. The appearance of the plate was excellent.

S The plate bottom became very hot and severely deformed with no soak-through and when handled by the rim, the plate felt like it had low rigidity.

TEST #6 RESULTS—Pancakes With Syrup and Precooked Bacon

J In this test, Swanson microwave pancakes and bacon breakfast (4.5 oz. size) were used. The semi-thawed meal consisted of three pancakes and three partially, precooked bacon strips. The pancakes and bacon were removed from the tray in carton and placed on plate. Approximately 5 teaspoons of pancake syrup was spooned over the pancakes and the assembled meal was covered with wax paper and microwaved for 2 minutes. Although the bottom of the plate got hot, the overall plate performance was excellent, i.e. no warpage, no soak-through, no loss in dimensional stability, and no staining. Some hot grease was exuded by the bacon during crisping but there was no observed damage to the plate. The appearance of the used plate was excellent.

S The plate bottom became hot and significantly deformed (especially in areas where bacon was placed), but no soak-through was observed and when handled by the rim, the plate felt soft.

TEST #7—Butter

J Butter (5-tsp. chunk) was placed on the plate and was loosely covered with wax paper and was microwaved for 3 minutes. The butter melted completely and covered the whole plate bottom. The butter began boiling toward the end of the test. The plate bottom got very hot and became slightly warped but no soak-through. The rim of the plate felt cool to touch enabling safe removal of the plate from the microwave oven. A small portion of the butter became charred but was easily washed off the plate. Overall plate performance was good.

S The plate bottom became very hot and was significantly warped but no soak-through was observed and the greasy film residue could not be washed off completely. Plate felt soft and rubbery when handled by the rim.

TEST #8 RESULTS—Bacon

J Three strips of raw, cured bacon were wrapped in three sheets of paper towel and cooked for 5 minutes. All of the bacon became crispy and about 20% of it was charred. The bottom of plate got very hot but most of the rim area was relatively cool to the touch. Grease exuded from bacon and soaked through the towel. The grease pooled on the plate bottom, side and on some rim areas. The grease which pooled in some rim regions caused localized melting of the plate but no holes were formed. The hot grease which pooled on plate bottom caused significant warpage but no soak-through. Overall plate performance for Test #8 was less satisfactory than Test #7.

S When the raw bacon was wrapped in paper toweling and cooked on the S plate, the bottom became very soft and stuck to the glass tray in the microwave. Under such hot grease conditions, the adhering polymer regions underwent localized melting and stretched when the plate was lifted off the glass tray. The plate was severely warped but no holes formed and no soak-through was noticed.

With the possible exception of raw bacon, the behavior of the J plate of this invention in the microwave oven is considered excellent with a variety of aqueous, greasy/fatty, sugary food combinations. No unusual or off odors were detected during and after cooking for each type of food directly on the plate. The foregoing data demonstrates the superior properties of the plates of this invention.

Crack Resistance

Low temperature crack resistance of rigid plates is of paramount importance when considering that product must survive during storage and shipping to point of sale. Normally, it is difficult to improve crack resistance or reduce brittleness of rigid polymeric materials without reducing the stiffness which is usually the case when introducing excessive amounts of softer extensible materials such as polyethylenes, rubber modified resins and the like. In order to be successful in imparting crack resistance without significantly reducing stiffness, one must add relatively low amounts of polyethylene or rubber modified additives, generally in the range of several to about 5 wt %. However, this invention shows that addition of low levels of polyethylene alone is not sufficient to promote crack resistance whereby the desired result is produced by a synergistic binary combination of polyethylene and $TiO_2$. Such low odor products have high crack resistance which renders them useful in the commercial sense.

EXAMPLES 14–21

There is provided in a still further aspect of the invention toughened, crack resistant articles. It has been found that polypropylene/mineral/polyethylene/titanium dioxide formulations without a coupling agent resist cracking. Generally, the articles have the components set forth in Table 9, in the amounts mentioned above in the summary of the invention herein. In Table 9, it is demonstrated that polyethylene/titanium dioxide exhibit synergy in resisting cracking.

TABLE 9

Low Temperature crack data for 9 inch plates made of PP/30% mica/10% $CaCO_3$ modified with various combinations of $TiO_2$, polyethylene, or coupling agent

| Example # | TiO2 (wt %) | LLDPE (wt %) | HDPE (wt %) | Coupling Agent (wt %)* | Percent Cracked plates at 0° F.** |
|---|---|---|---|---|---|
| 14 | — | 4 | — | — | 100 (n = 5) |
| 15 | — | — | — | 2.5 | 100 (n = 5) |
| 16 | 1.9 | — | — | — | 100 (n = 5) |
| 17 | — | 4 | — | 2.5 | 100 (n = 5) |
| 18 | 1.9 | 0 | 0 | 2.5 | 100 (n = 5) |
| 19 | 0.5 | 4 | — | 2.5 | 60 (n = 5) |
| 20 | 0.5 | 4 | 0 | 0 | 0 (n = 5) |
| 21 | 0.5 | 0 | 4 | 0 | 0 (n = 10) |

*coupling agent is maleic anhydride modified PP grade Aristech Unite NP-620. Other ingredients are: Mica = Franklin Minerals L 140, CaCO3 = Huber Q325, PP = Exxon Escorene PP4772, LLDPE = Novapol Novachemical G1-2024A

**percentage of plates which cracked at 0° F. for specimen sets comprised of the indicates number n Crack resistance of Examples 14 through 21 was evaluated in the laboratory according to method set forth below which was found useful as an investigative tool for optimizing the formulation with various combination of $TiO_2$, polyethylene, or coupling agent. A laboratory procedure was devised and used to evaluate the crack resistance of plates. Specifically, following is a description of test instruments and associated fixtures used to subject plates to a repeatable rim crushing force. The model numbers of standard equipment used on this procedure are recited below and additional fixtures used in these tests were employed as follows:

Instron—Model #55R402 was used which was equipped with Instron Environmental Chamber Model #3111. The Instron environmental chamber—Model #3111 was modified to control low temperatures with liquid nitrogen. It was equipped with a control solenoid mounted on the rear of the cabinet and an electronic control module mounted on the control panel assembly. The temperature within the chamber was controlled in relationship to the setpoint on the front panel temperature dial. A thermocouple within the chamber provides feed back to the device. A mercury thermometer was placed in the chamber and oriented so that temperature within the chamber was visible through an insulated. glass door. It was monitored and adjusted to 0° C. using the panel temperature dial. A push rod was attached to the load cell of the instron and was passed through an opening in the top of the environmental chamber. A circular metal device measuring 100 mm in diameter and 10 mm in thick was attached to the end of the push rod inside the chamber. This circular metal device was used to contact the edge of a plastic plate during testing.

The plate support fixture was placed on a circular metal base support which measured 140 mm in diameter by 14 mm thick. This metal base support was located just above the inside floor of the environmental chamber. It was attached to a support rod that passes through the floor of the environmental chamber and attached to the base of the instron. Centering stops were provided on the metal base support so that the plate support fixture could be repeatedly placed at the same location in the environmental cabinet.

The plate support fixture is constructed of 5-mm thick sheets of plexiglas. The main base of this fixture measures 100×125 mm. The 125-mm dimension represents the width of the front of the mixture. The edge of the 125 mm side of a second plexiglas panel measuring 160×125 mm was permanently attached to the plexiglas main base. This panel was attached at a 90° angle to the main base and 35 mm in from the front edge. An L shaped plexiglas component was attached to the main base behind and parallel to the permanent panel by thumbscrews. Two 20-mm long slots were provided in the base of the L shaped component to allow attachment and provide movement for adjustment to hold the test plate. The short leg or base of the L shaped component faces the rear of the fixture. A block measuring 40×25×15 mm thick was permanently attached at the upper most end at the center of the L shaped component. This block is located on the front side of the moveable component or just opposite the short leg of the L shaped component, while an adjustable plate stop was attached to one side of the moveable L shaped component.

The methodology for testing the crack resistance of plates was as follows. The test plate was secured in a vertical position on edge in the plate support fixture. The bottom of the test plate was placed against the permanently attached plexiglas panel of the plate support fixture. The thumbscrews were loosened on the moveable portion of the plate support fixture. The L shaped moveable component was moved toward the plate. The plate was held in a vertical position by the fixed plexiglas panel and the block which was attached to the wall of the L shaped moveable component.

The plate stop located on the L shaped moveable component was adjusted so that the center of the plate would align with the center of the plate support fixture. The plate support fixture along with the test plate secured in a vertical position was placed on the metal base support in the environmental chamber. The instron was adjusted so that the push rod crush assembly was located 0.5 inches above the plate edge.

Prior to the test, the environmental chamber was adjusted to 0° F. After placement of the plate support fixture along with the test plate secured in a vertical position in the environmental chamber, the chamber had to re-establish 0° F. This time period was about 30 seconds. After re-establishment of the test temperature, the plate was conditioned for an additional five minutes prior to the test. The crosshead speed of the instron was set at 40 inches per minute. After the five minute conditioning time period, the instron was activated and the edge crushing force applied. A set of five or a set of ten replicate plates was tested for each condition. The total number of plates tested and the total number plates showing rim crack failure for each condition tested are reported in Table 9. In addition, the percentage of plates which cracked was calculated as shown above. The above formulations for crack resistance testing were compounded in the temperature range of 400 to about 425° F. on commercial Banbury equipment using batch sizes in the range of 150–200 lb. and nominal mixing times of 3 min. followed by underwater pelletizing.

Pellets were subsequently extruded at 370° F. as cast sheets in the range of 18 mil. Sheet line conditions also included a screw RPM value of 100, a chill roll temperature of 130° F. Plates were subsequently vacuum thermoformed using a female mold, trimmed, and thereafter tested for crack resistance.

Data on Examples 14 through 16 show that presence of $TiO_2$, polyethylene, or coupling agent alone is not sufficient to promote crack resistance of plates comprised of PP/mica/$CaCO_3$. In addition, data on Examples 17 and 18 show that binary combinations of polyethylene with coupling agent or $TiO_2$ with coupling agent are two cases which are also not sufficient for imparting crack resistance. Furthermore, the tertiary combination of $TiO_2$, polyethylene, and coupling agent (Example 68) also does not impart sufficient crack resistance, as evidenced by the majority of samples which exhibit cracking. Rather, the useful additive packages of this invention (Examples 20 and 21) comprises the binary system of polyethylene (either LLDPE or HDPE) with at least 0.5 wt % $TiO_2$ whereby crack resistance is excellent as evidenced by no cracked samples.

EXAMPLES 22–29

Additional plates were fabricated in accordance with the foregoing procedures and compositions; crack testing results appear in Table 10 below.

TABLE 10

Crack Data and Physical Properties for Various Compounded Formulations Base Formulation: PP/30% Mica/10% $CaCO_3$

| | Formulation | | | Melt Flow | Filler | Flexural Modulus | 9" Plate | Product | |
|---|---|---|---|---|---|---|---|---|---|
| Example | $TiO_2$ (wt. %) | PE (4 wt. %) | Coupling Agent* | g/10 min. @ 230° C. | Content (Wt. %) | Tangent (psi) | Rigidity (grams/0.5") | Weight (grams) | Crack Data @ 0° F. (# Cracked Total) |
| 22 | 0 | LLDPE | No | 1.45 | 39.4 | 505,000 | 288 | 19.3 | 5/5 |
| 23 | 1.9 | LLDPE | No | 1.64 | 40.6 | 581,600 | 422 | 23.13 | 0/5 |
| 24 | 1.2 | LLDPE | No | 2.05 | 39.8 | 578,500 | 385 | 22.12 | 0/5 |
| 25 | 0.5 | LLDPE | No | 1.77 | 38.6 | 487,500 | 286 | 20.65 | 0/5 |
| 26 | 1.9 | HDPE | No | 1.5 | 40.6 | 637,500 | 436 | 22.70 | 1/5 |
| 27 | 1.9 | 0 | Yes | 1.9 | 39.0 | 717,585 | 417 | 21.25 | 5/5 |
| 28 | 1.9 | LLDPE | Yes | 1.6 | 39.6 | 494,000 | 391 | 21.6 | 5/5 |
| 29 | 1.9 | 0 | Yes | 1.2 | 40.3 | 593,000 | 353 | 20.8 | 5/5 |

*When present, coupling agent concentration is 2.5%

In a still further aspect of the invention, food contact articles are provided by way of preparing a melt-compounded composition with from about 40 to 90 percent of a polypropylene polymer, about 10 to about 50 percent by weight of a mineral filler and optionally an effective amount of an odor-reducing compound. The melt-compounded composition is extruded into a sheet and formed into a food contact article and is characterized by a relative aroma index, relative to a composition containing 30 weight percent mica only, of less than about 0.75; preferably less than about 0.6. The relative aroma index is thus defined similarly as above; however, relative to a mica composition without an odor suppressing compound such as calcium carbonate. Stated another way, the relative aroma index is determined in the same way as the odor index utilizing the AromaScan®_device as noted above or other suitable instrument, except a 30 wt. % mica filled composition is used as the reference (or denominator) compound. In equation form, $$\text{Relative Aroma Index} = \frac{\text{average readings of pellets including a primary mineral filler and optionally including calcium carbonate or other odor suppressing compound}}{\text{average readings of pellets including 30 wt\% mica only without an odor suppressing basic compound}}$$

Thus, a composition consisting essentially of 30% talc, 10% calcium carbonate and the balance polypropylene would have a relative aroma index, relative to a 30% by weight mica composition of:

$$\text{Relative Aroma Index} = \frac{\text{average readings of 30\% talc, 10\% calcium carbonate, 60\% polypropylene composition}}{\text{average readings of 30\% mica, 70\% polypropylene composition}}$$

The invention also includes: (a) preparing a melt-compounded composition including from about 90 percent by weight of a polypropylene polymer, from about 10 to about 50 percent by weight of a primary mineral filler and optionally an effective odor-reducing amount of a basic or optionally acidic organic or inorganic compound; (b) extruding the melt-compounded composition into a sheet; and (c) forming a food contact article from the sheet, wherein the melt compounded composition exhibits a relative aroma index of 0.75 or less. Particularly preferred primary mineral fillers include talc, kaolin, bentonite and wollastonite.

A preferred embodiment of this invention is illustrated in FIGS. 1A through 4. Throughout the following description of the bowl of FIGS. 1A through 4, each of the dimensions are referenced with respect to a given diameter, D, which, in accordance with the present invention as illustrated is approximately 7.3 inches. However, the particular diameter of the containers is not a critical limitation and is only set forth herein by way of example. It is the relationship between the various portions of the rim configuration which are essential. The substantially planar central portion of the bowl may or may not have a crown. A slight crown improves stability during use. The crowned inner region 340 in accordance with the illustrated embodiment in FIGS. 1A through 4, has a crown height Y5 which is approximately 0.004 D to 0.012 D or preferably 0.008 D, and encompassing a radius X1 which is equal to approximately 0.2 D to 0.3 D and preferably 0.25 D. Adjoining an outer periphery of the crowned inner region 340 is a sidewall portion 342 including first annular region 344 having a radius of curvature, R1, equal to approximately 0.05 D to 0.15 D and preferably 0.11 D with the center point thereof being positioned at a height Y1 above the lowermost point, P, transitioning between the crowned inner region 340 and the first annular region 344. Included angle, A1, indicated at 346 of the first annular region 344 is from about 50° to about 85° and is preferably 65° to 80° or approximately 72°. The first arc, S1, thus has a length of about 0.96 inches. Adjoining the periphery of the first annular region 344 in the sidewall portion 342 is a second annular region 348 having a radius of curvature equal of approximately 0.8 D to 1.2 D and preferably 0.96 D with the centerpoint thereof being positioned a distance Y2 below the lowermost point, P, transitioning between the crowned inner region 340 and the first annular region 344. The included angle of arc A2 indicated generally at 350 of the second annular region 348 is from about 5° to 9° and is preferably 6.5 to 7.5° or approximately 7°. S2 thus has an arc length of about 0.89 inches. Adjoining the periphery of the second annular region 348 in the sidewall portion 342 is a third annular region 352 having a radius of curvature, R3, equal to approximately 0.1 D to 0.2 D and preferably 0.15 D with the centerpoint thereof being positioned a height, Y3, above the lowermost point, P, transitioning between the crowned inner region 340 and the first annular region 344. Included angle, A3, indicated at 354 of the third annular region 352 is from about 25° to 40° and is preferably 30° to 35° or approximately 33°. The arc length, S3, of this region is thus about 0.6 inches. Adjoining the sidewall portion 342 is a flange portion 356 including a fourth annular region consisting of regions 358 and 360 which have the same radius of curvature. Adjoining the third annular region 352 is a fourth annular region beginning with annular region 358 which extends to the uppermost bowl height and continuing with annular region 360 to bowl diameter D. Annular regions 358 and 360 are equivalent to one annular region, flange portion 356 since both have the same radius of curvature of approximately 0.02 D to 0.05 D and preferably 0.03 D with the centerpoint thereof being positioned a height, Y4, above the lowermost point, P, transitioning between the crowned inner region 340 and the first annular region 344. Included angle, A4, indicated at 362 of the fourth annular region 356 is from about 45° to 85° and preferably 70° to 75° or approximately 73°. An arc, S4, thus has a length of about 0.32 inches.

Figure 4:
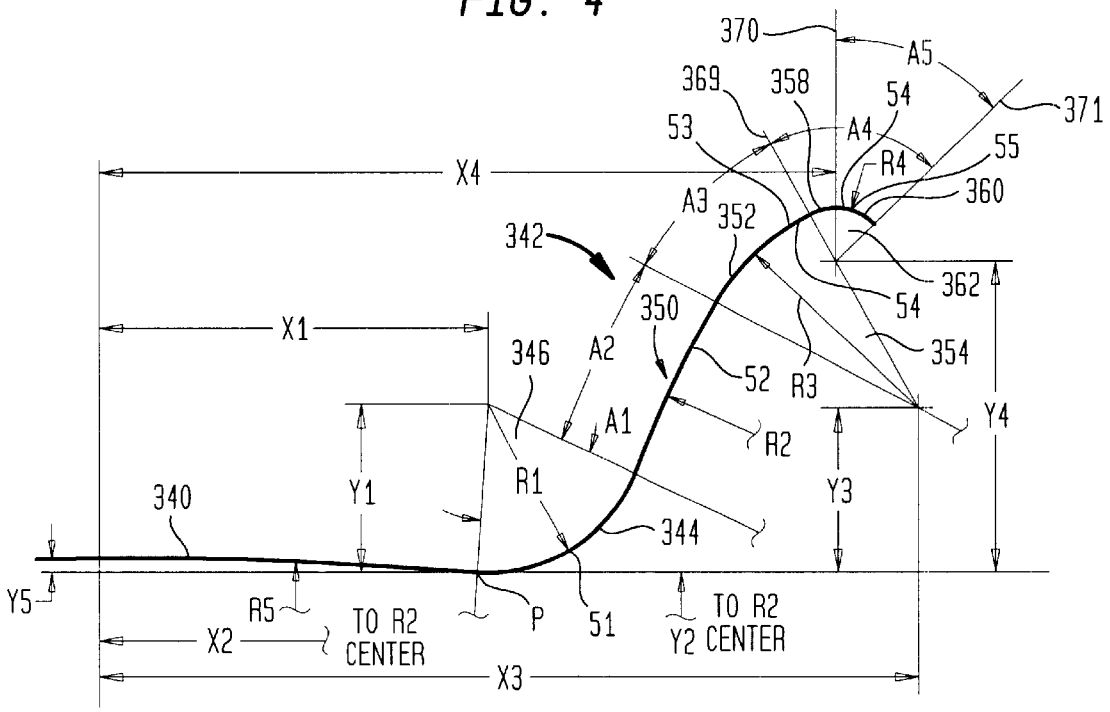
FIG. 4 is a profile of the bowl shown in FIGS. 1A and 1B.

As will be appreciated from FIG. 4, angle A4, which extends between 369 and 371 has within it a downwardly convex sub-arc, S5, which extends from the apex indicated at 370 to the outermost edge of the bowl over an angle A5. In other words, the radius, R4, subtends on arc, S4, which has a downwardly convex outer portion, S5. R4 subtends S4 over the entire angle, A4, while R4 subtends S5 over angle A5. Generally, angle A5 is from about 35° to about 55° with from about 40° to about 50° being preferred. Arc S5 has an arc length of about 0.19 inches as shown.

The more significant dimensions of the bowl described above are summarized in Table 11 below along with typical and preferred ranges for the dimensions and angles. Table 11 applies to a bowl having a minimal volume of about 20 fluid ounces. In order to scale the dimensions (and ranges thereof) for other size bowls, one simply multiplies the values in Table 11 by the volumetric ratio to the ⅓ power. Thus, for a 30 ounce bowl, one would apply a factor of $(30/20)^{1/3}$ or about 1.15 to the diameter, radius, and arc length values in Table 11. Generally, this procedure is used for any bowl defining a volume of from about 3 to about 40 ounces, wherein scale factors would be from about 0.53 to about 1.25. More typically, one would apply the data in Table 11 to a bowl design having a volume of from about 15 to about 30 ounces, that is, use scale factors of from about 0.90 to about 1.15.

Figure 1B:
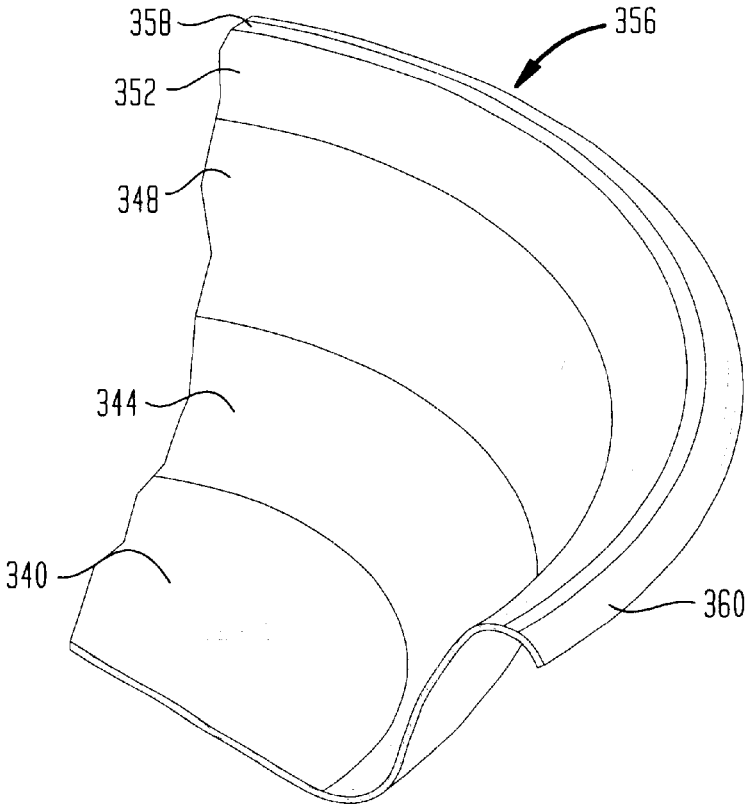
Figure 2A:
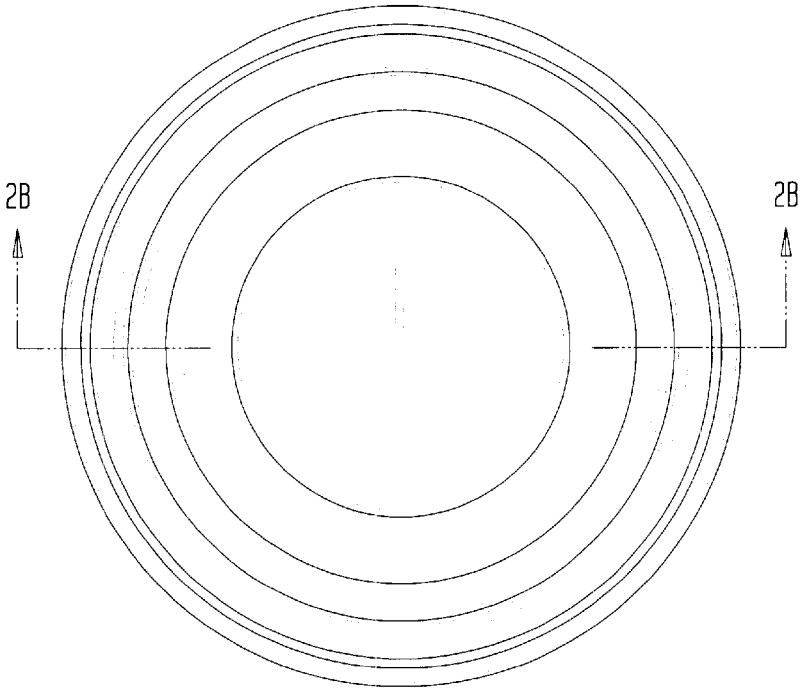
FIGS. 2A through 2C include a cross-sectional view of the bowl shown in FIGS. 1A and 1B.
Figure 2B:
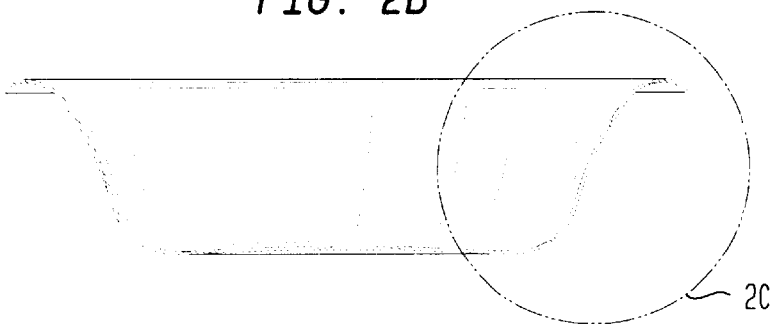
Figure 2C:
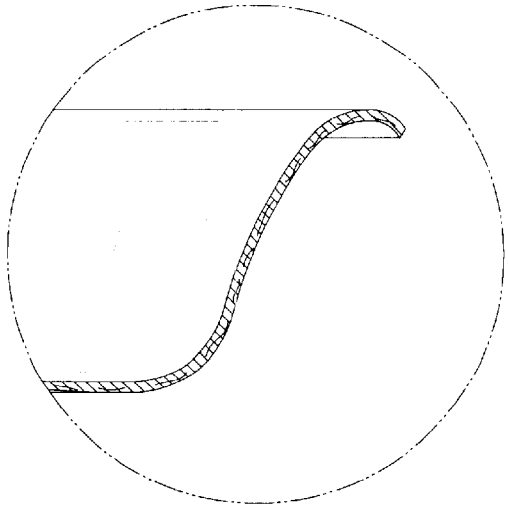
Figure 3:
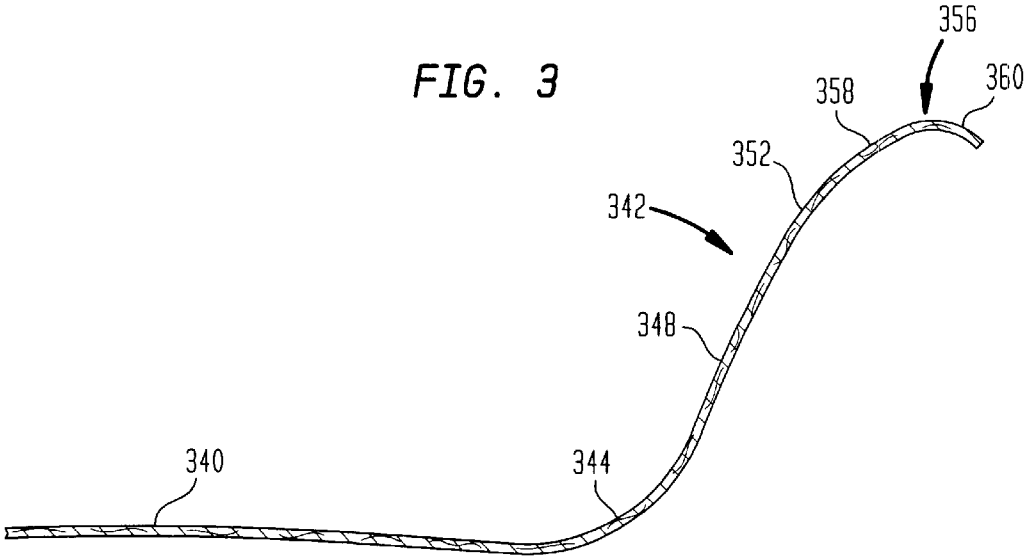
FIG. 3 is a radial cross section of the bowl shown in FIGS. 1A and 1B.

Alternatively, one might choose to have a profile as shown in FIG. 1 and following and adjust the bowl volume by simply changing the overall diameter, D, of the bowl to achieve the desired contained capacity. In other words, the bowl would have the same height and profile, but that profile would be horizontally displaced from the corresponding opposing portion of the bowl. This latter procedure is perhaps most suitable for larger bowls where height is limited by manufacturing conditions or consumer preference.

TABLE 11

20 Ounce Bowl Dimensions (Inches and Degrees)

| | Illustrated Value | Typical Range | Preferred Range |
|---|---|---|---|
| R1 | 0.77 | 0.55–0.9 | 0.6–0.85 |
| A1 | 72 | 50–85 | 65–80 |
| S1 | 0.96 | 0.5–1.4 | 0.7–1.2 |
| R2 | 7 | 5–9 | 6.5–7.5 |
| A2 | 7.25 | 5–10 | 6.5–8 |
| S2 | 0.89 | 0.4–1.6 | 0.74–1.1 |
| R3 | 1.0 | 0.8–1.2 | 0.9–1.1 |
| A3 | 33 | 25–40 | 30–35 |
| S3 | 0.6 | 0.35–1.1 | 0.5–0.7 |
| R4 | 0.25 | 0.15–0.35 | 0.2–0.3 |
| A4 | 73 | 60–85 | 70–75 |
| S4 | 0.32 | 0.15–0.5 | 0.25–0.4 |
| A5 | 44 | 35–55 | 40–50 |
| S5 | 0.19 | 0.09–0.34 | 0.14–0.26 |
| D | 7.3 | 6.5–9 | 7.0–7.5 |

As will be appreciated from the foregoing, a disposable food serving bowl in accordance with the invention is formed from a mineral-filled polyolefin sheet with a characteristic diameter, D, of about 7.3 inches also has a substantially planar center portion; a first sidewall portion extending outwardly from said center planar portion, said first sidewall portion being upwardly convex and subtending a first arc, S1, with a first radius of curvature, R1; a second sidewall portion joined to said first sidewall portion, and extending outwardly therefrom, said second sidewall portion being downwardly convex, subtending a second arc, S2, with a second radius of curvature, R2; a third sidewall portion joined to said second sidewall portion and extending outwardly therefrom, said third sidewall portion being downwardly convex, subtending a third arc, S3, with a third radius of curvature, R3; and, a fourth rim portion joined to said third sidewall portion and extending outwardly therefrom, said fourth rim portion being downwardly convex subtending a fourth arc, S4, having a fourth radius of curvature, R4; wherein said fourth radius of curvature, in inches, is from about 0.15 to about 0.35. Scaling on a volumetric basis may be performed, or one might choose to simply change the bowl diameter while maintaining the same general bowl height and profile. In general, the second radius of curvature, R2, is greater than the third radius of curvature, R3, which, in turn, is greater than the first radius of curvature, R1. The first radius of curvature, R1 is greater than said fourth radius of curvature, R4.

In preferred embodiments, the first arc, S1, and the second arc, S2, are substantially equivalent in length. The first arc, S1, is greater in length than the third arc, S3, and is also greater in length than the fourth arc, S4.

The first arc, S1, extends over an angle, A1, of from about 50 to about 85 degrees, while the second arc, S2, extends over an angle, A2, of from about 5 to about 9 degrees. The third arc, S3, extends over an angle, A3, of from about 25 to about 40 degrees and the fourth arc, S4, extends over an angle, A4, of from about 60 to about 85 degrees. Arc, S4, preferably has a downwardly convex terminal portion, S5, which extends downwardly from its vertical apex over an angle, A5, which is from about 35 to about 55 degrees. This latter feature is particularly desirable to import rigidity to the bowl.

While the invention has been exemplified and described in detail, numerous modifications to specific examples within the spirit and scope of the invention will be apparent to those of skill in the art. The invention is defined in the appended claims.

What is claimed is:

1. A disposable food serving bowl formed of a mineral-filled polyolefin sheet comprising a substantially planar central portion, a sidewall portion and a flange portion having a characteristic volume, V, measured in fluid ounces;

said sidewall portion extending outwardly and upwardly from said central substantially planar portion;

said flange portion extending outwardly from said sidewall portion and being characterized by an outer arcuate rim portion with a radius of curvature subtending an outermost arc, said outermost arc defining the outer edge of said bowl and having a downwardly projecting terminus, wherein said radius of curvature of said outermost arc in inches is from about $(V/20)^{1/3}\times0.15$ to about $(V/20)^{1/3}\times0.35$.

2. The disposable food serving bowl according to claim 1, wherein said outermost arc extends over an angle from its vertical apex point to its terminus of from about 35 degrees to about 55 degrees.

3. The disposable food serving bowl according to claim 1, wherein said outermost arc extends over an angle form its vertical apex point to its terminus of from about 40 degrees to about 50 degrees.

4. The disposable food serving bowl according to claim 1, wherein said radius of curvature of said outermost arc is from about $(V/20)^{1/3}\times0.2$ to about $(V/20)^{1/3}\times0.3$.

5. The disposable serving bowl according to claim 1, wherein said outermost arc extends over an angle of from about 60 to about 85 degrees.

6. The disposable serving bowl according to claim 1, wherein said outermost arc extends over an angle of from about 70 to about 75 degrees.

7. The disposable food serving bowl according to claim 1, wherein said article has a wall thickness of from about 10 to about 80 mils.

8. The disposable food serving bowl according to claim 7, wherein said article has a wall thickness of from about 15 to about 25 mils.

9. The disposable food serving bowl according to claim 1, having a wall thickness from about 10 to about 80 mils consisting essentially of from about 40 to about 90 percent by weight of a polypropylene polymer, from about 10 to about 60 percent by weight of a mineral filler, from about 1 to about 15 percent by weight polyethylene, from about 0.1 to about 5 weight percent titanium dioxide and optionally including a basic organic or inorganic compound comprising the reaction product of an alkali metal or alkaline earth element with carbonates, phosphates, carboxylic acids as well as alkali metal and alkaline earth element oxides, hydroxides, or silicates and basic metal oxides, including mixtures of silicon dioxide with one or more of the following oxides: magnesium oxide, calcium oxide, barium oxide, and mixtures thereof.

10. The disposable food serving bowl according to claim 9, wherein said basic organic or inorganic compound comprises calcium carbonate and said calcium carbonate is present in an amount of from about 5 to about 20 weight percent.

11. The disposable food serving bowl according to claim 9 wherein polyethylene is present from about 2.5 to about 15 percent by weight.

12. The disposable food serving bowl according to claim 11, wherein polyethylene is present from about 4 to about 5 weight percent.

13. The disposable food serving bowl according to claim 9 wherein titanium dioxide is present from about 0.1 to about 3 weight percent.

14. The disposable food serving bowl according to claim 13, wherein titanium dioxide is present from about 0.25 to about 2 percent by weight.

15. The disposable food serving bowl according to claim 9, wherein titanium dioxide is present in an amount of at least about 0.5 percent by weight.

16. The disposable food serving bowl according to claim 9, wherein said article has a wall caliper of from about 10 to about 50 mils.

17. The disposable food serving bowl according to claim 16, wherein said article has a wall caliper of from about 15 to about 25 mils.

18. The disposable food serving bowl according to claim 9, wherein said mineral filler is mica.

19. The disposable food serving bowl according to claim 9, wherein said polypropylene polymer is isotactic polypropylene.

20. The disposable food serving bowl according to claim 19, wherein said isotactic polypropylene has a melt index of from about 0.3 to about 4.

21. The disposable food serving bowl according to claim 20, wherein said isotactic polypropylene has a melt flow index of about 1.5.

22. The disposable food serving bowl according to claim 9, wherein said polyethylene is HDPE.

23. The food contact article according to claim 9, wherein said polyethylene is LLDPE.

24. A disposable food serving bowl formed of a mineral-filled polyolefin sheet comprising a substantially planar central portion, a sidewall portion and a flange portion having a characteristic volume, V, measured in fluid ounces;

said sidewall portion extending outwardly and upwardly from said central substantially planar portion;

said flange portion extending outwardly from said sidewall portion and being characterized by an outer arcuate rim portion with a radius of curvature subtending an outermost arc, said outermost arc defining the outer edge of said bowl and having a downwardly projective terminus, wherein said radius of curvature of said outermost arc in inches is from about $(V/20)^{1/3}\times0.15$ to about $(V/20)^{1/3}\times0.35$, and wherein said radius of curvature of said outermost arc in inches is from about 0.15 to about 0.35.

25. The disposable food serving bowl according to claim 24, wherein said outermost arc extends over an angle from its vertical apex point to its terminus of from about 35 degrees to about 55 degrees.

26. The disposable food serving bowl according to claim 24, wherein said outermost arc extends over an angle form its vertical apex point to its terminus of from about 40 degrees to about 50 degrees.

27. The disposable food serving bowl according to claim 24, wherein said radius of curvature of said outermost arc is about 0.2 to about 0.3 inches.

28. The disposable food serving bowl according to claim 27, wherein said radius of curvature is from about 0.2 to about 0.3 inches and said polyolefin is selected from the group consisting of polypropylene and polyethylene.

29. A disposable food serving bowl formed of a mineral-filled polyolefin sheet with a characteristic volume, V, in fluid ounces, having a substantially planar center portion;

a first sidewall portion extending outwardly from said substantially planar center portion, said first sidewall portion being upwardly convex and subtending a first arc with a first radius of curvature;

a second sidewall portion joined to said first sidewall portion, and extending outwardly therefrom, said second sidewall portion being downwardly convex, subtending a second arc with a second radius of curvature;

a third sidewall portion jointed to said second sidewall portion and extending outwardly therefrom, said third sidewall portion being downwardly convex, subtending a third arc with a third radius of curvature; and, a fourth rim portion jointed to said third sidewall portion and extending outwardly therefrom, said fourth rim portion being downwardly convex subtending a fourth arc having a fourth radius of curvature; wherein said fourth radius of curvature, in inches, is from about $(V/20)^{1/3}\times0.15$ to about $(V/20)^{1/3}\times0.35$.

30. The disposable food serving bowl according to claim 29, wherein said fourth arc extends over an angle from its vertical apex point to its terminus of from about 35 degrees to about 55 degrees.

31. The disposable food serving bowl according to claim 30, wherein said fourth arc extends over an angle from its vertical apex point to its terminus from about 40 degrees to about 50 degrees.

32. The disposable food serving bowl according to claim 29, wherein said second radius of curvature is greater than said third radius of curvature.

33. The disposable serving bowl according to claim 31, wherein said second radius of curvature is greater than said third radius of curvature and said third radius of curvature is greater than said first radius of curvature.

34. The disposable serving bowl according to claim 33, wherein said second radius of curvature is greater than said third radius of curvature, said third radius of curvature is greater than said first radius of curvature and said first radius of curvature is greater than said fourth radius of curvature.

35. The disposable serving bowl according to claim 29 wherein said first arc and said second arc are substantially equivalent in length.

36. The food disposable serving bowl according to claim 29, wherein said first arc is greater in length than said third arc.

37. The disposable food serving bowl according to claim 29, wherein said first arc is greater in length than said fourth arc.

38. The disposable food serving bowl according to claim 29, wherein said first arc extends over an angle of from about 50 to about 85 degrees.

39. The disposable food serving bowl according to claim 29, wherein said second arc extends over an angle of from about 5 to about 9 degrees.

40. The disposable food serving bowl according to claim 29, wherein said third arc extends over an angle of from about 25 to about 40 degrees.

41. The disposable food serving bowl according to claim 29, wherein said fourth arc extends over an angle of from about 60 to about 85 degrees.

* * * * *